US010808484B2

(12) United States Patent
Goy et al.

(10) Patent No.: US 10,808,484 B2
(45) Date of Patent: Oct. 20, 2020

(54) WELLHEAD CONNECTION FOR PRESSURE-CONTROL OPERATIONS

(71) Applicant: Lee Specialties Inc., Edmonton (CA)

(72) Inventors: Brent Goy, Edmonton (CA); Cliff Wahlstrom, Sherwood Park (CA)

(73) Assignee: Lee Specialties Inc., Edmonton (CA)

( * ) Notice: Subject to any disclaimer, the term of this patent is extended or adjusted under 35 U.S.C. 154(b) by 0 days.

(21) Appl. No.: 16/359,960

(22) Filed: Mar. 20, 2019

(65) Prior Publication Data

US 2019/0292870 A1 Sep. 26, 2019

Related U.S. Application Data

(60) Provisional application No. 62/645,899, filed on Mar. 21, 2018.

(51) Int. Cl.

| | |
|---|---|
| ***E21B 33/03*** | (2006.01) |
| ***E21B 47/06*** | (2012.01) |
| *E21B 41/00* | (2006.01) |

(52) U.S. Cl.

CPC ..... *E21B 33/03* (2013.01); *E21B 47/06* (2013.01); *E21B 41/0021* (2013.01)

(58) Field of Classification Search

CPC ..... E21B 33/03; E21B 33/038; E21B 33/04; E21B 33/0415; E21B 33/0422; E21B 33/047; E21B 33/05; E21B 41/0021; E21B 47/06

See application file for complete search history.

(56) References Cited

U.S. PATENT DOCUMENTS

| | | | | |
|---|---|---|---|---|
| 3,096,999 | A | 7/1963 | Ahlstone et al. | |
| 3,181,901 | A | 5/1965 | Watts | |
| 3,231,297 | A | 1/1966 | Watts | |
| 3,307,862 | A | 3/1967 | Brown | |
| 3,403,931 | A | 10/1968 | Crain et al. | |
| 3,661,409 | A | 5/1972 | Brown et al. | |
| 3,843,168 | A | 10/1974 | Morrill et al. | |
| 4,153,278 | A | 5/1979 | Ahlstone et al. | |
| 4,225,160 | A | 9/1980 | Ortloff | |
| 6,499,773 | B1 | 12/2002 | Ostergaard | |
| 6,609,734 | B1 | 8/2003 | Baugh | |
| 7,159,652 | B2 | 1/2007 | McGuire et al. | |
| 7,523,644 | B2 | 4/2009 | Van Winkle | |
| 8,272,444 | B2 | 9/2012 | Baugh | |
| 9,644,443 | B1 * | 5/2017 | Johansen | E21B 33/038 |
| 9,879,496 | B2 | 1/2018 | Johansen et al. | |
| 10,605,030 | B1 * | 3/2020 | Baugh | E21B 34/02 |

(Continued)

OTHER PUBLICATIONS

API, ANSI/API Specification 16A Specification for Drill-Through Equipment (3d ed. Jun. 2004), pp. 2-3, 16-28.

(Continued)

*Primary Examiner* — David Carroll

(74) *Attorney, Agent, or Firm* — D. Tiller Law PLLC; Donald Tiller

(57) ABSTRACT

A wellhead connection is disclosed that includes a means for selectively clamping a nightcap or crossover to a flange assembly through selective application of hydraulic pressure to a hydraulic motor and a means for selectively positioning a nightcap through selective application of hydraulic pressure to a plurality of hydraulic cylinders.

10 Claims, 28 Drawing Sheets

(56) References Cited

U.S. PATENT DOCUMENTS

2013/0309032 A1 11/2013 Waseby
2016/0273295 A1* 9/2016 Rahim ..... E21B 19/00

OTHER PUBLICATIONS

Elmar, Pressure Control Equipment (catalog), Quick Test Sub.
David O Bankston and Hsin Kuo, PVP2014-28343 Development of Design Rules for Three-Segment Pipe Clamp Connectors, Proceeding of the ASME 2014 Pressure Vessels & Piping Conference (2014).

* cited by examiner

A – A

B – B

F – F

WELLHEAD CONNECTION FOR PRESSURE-CONTROL OPERATIONS

CROSS-REFERENCE TO RELATED APPLICATIONS

This application claims the benefit of U.S. Provisional Application No. 62/645,899, filed on Mar. 21, 2018, which application is incorporated herein by reference.

BACKGROUND

This invention pertains generally to systems and methods for connecting pressure-control equipment (PCE) to a wellhead. More specifically, the invention is directed to technology for remotely securing PCE to a wellhead.

SUMMARY

The present invention enables remote control of a wellhead connection (or "lock") to allow pressure-control operations or to place the well in standby through use of a nightcap. Connection of the PCE to a wellhead is remotely controlled through selective application of hydraulic pressure to a means for controlling a clamp. The means may include a hydraulic motor rotating a screw-threaded shaft in one direction to open the clamp and in another direction to close the clamp. The clamp is used to secure a crossover that can be connected on one end to the PCE and on the other end to a flange assembly connected to the wellhead. The clamp may also secure the nightcap to the flange assembly connected to the wellhead to protect the wellbore from the outside environment (e.g., falling debris) and to protect the environment from the wellbore (e.g., pressurized wellbore fluids) when the well is in standby. The nightcap may be selectively positioned through selective application of hydraulic pressure to a means for moving the nightcap. The means may include a first hydraulic cylinder for raising and lowering the nightcap and may include a second hydraulic cylinder for positioning the nightcap above the wellhead or away from the wellhead.

BRIEF DESCRIPTION OF THE DRAWINGS

These and other features, aspects, and advantages of the present invention will become better understood with reference to the following description, appended claims, and accompanying drawings where:

DESCRIPTION

Figure 1A:
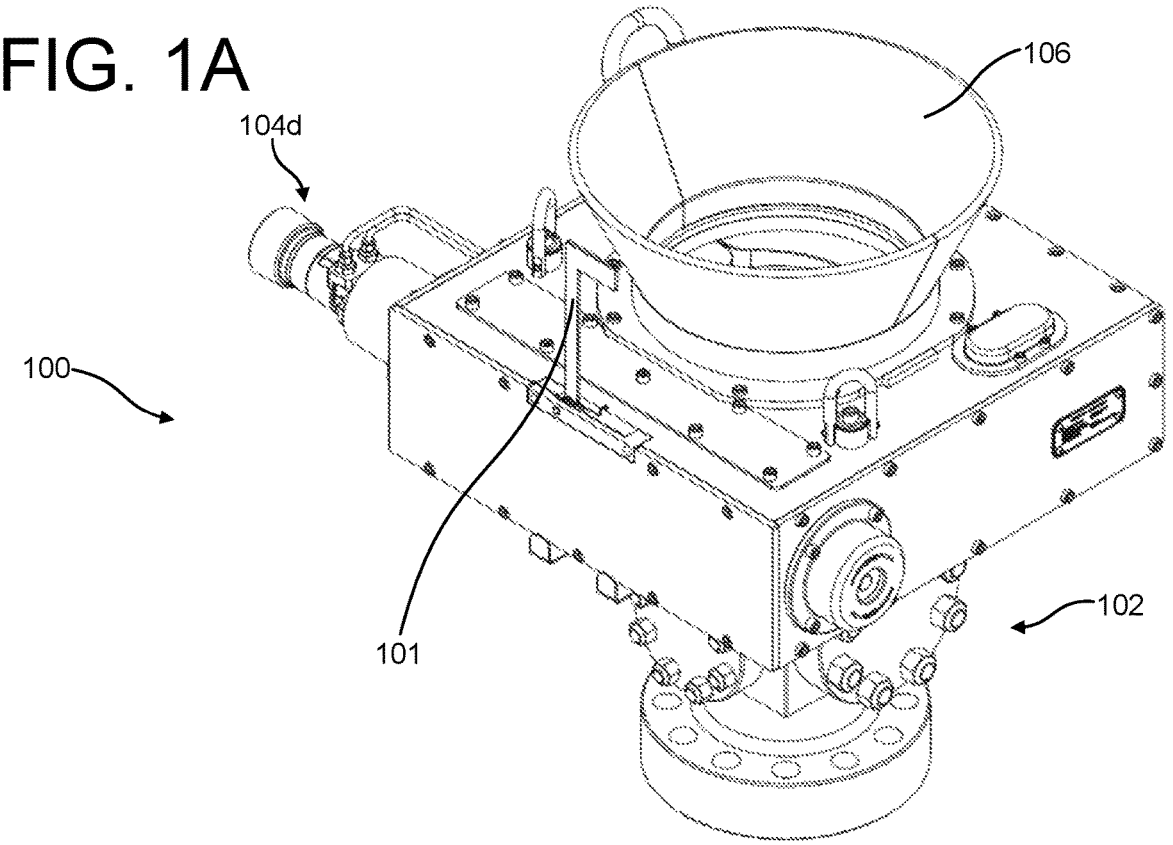
FIGS. 1A-1H are various views of an exemplary wellhead connection according to an aspect of the invention.
Figure 1B:
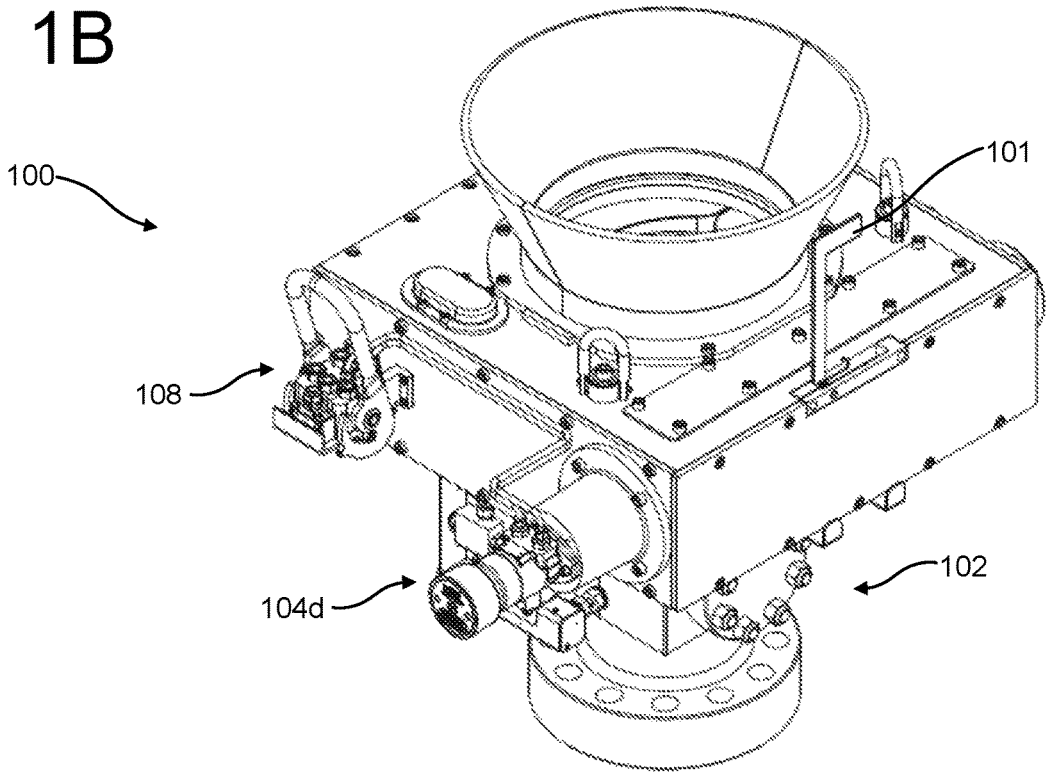
Figure 1C:
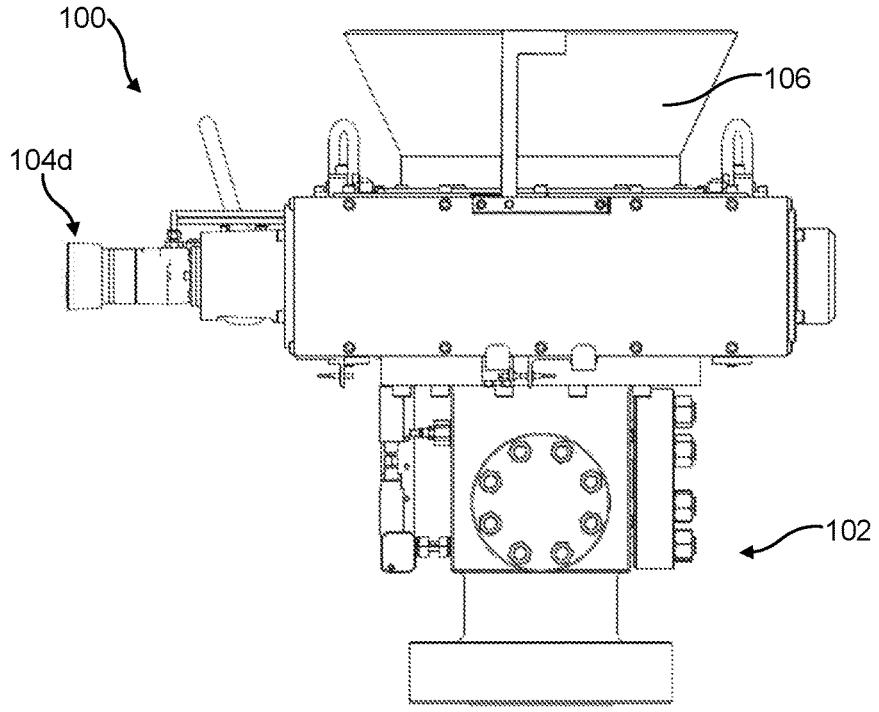
Figure 1D:
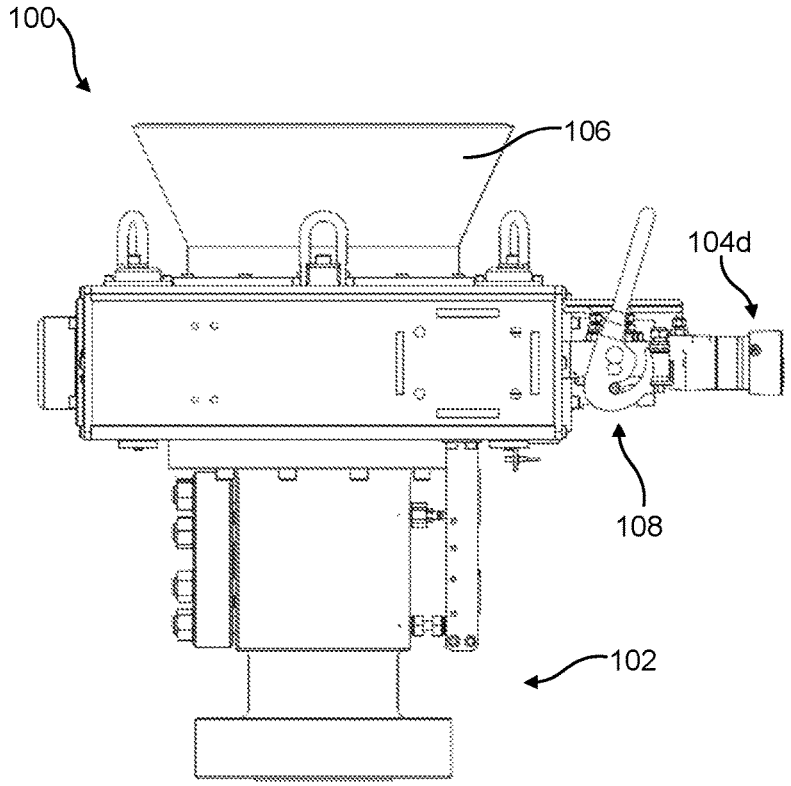
Figure 1E:
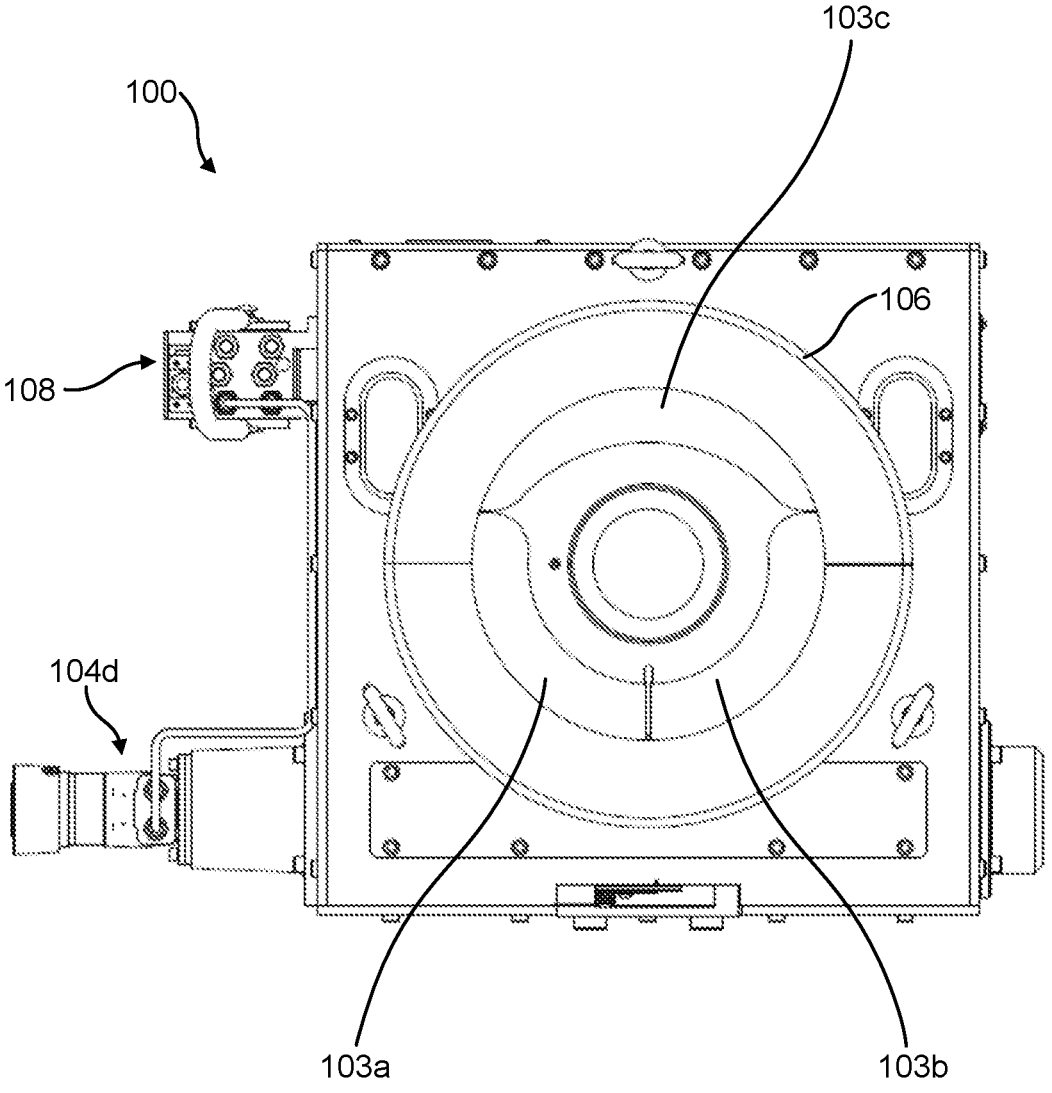
Figure 1F:
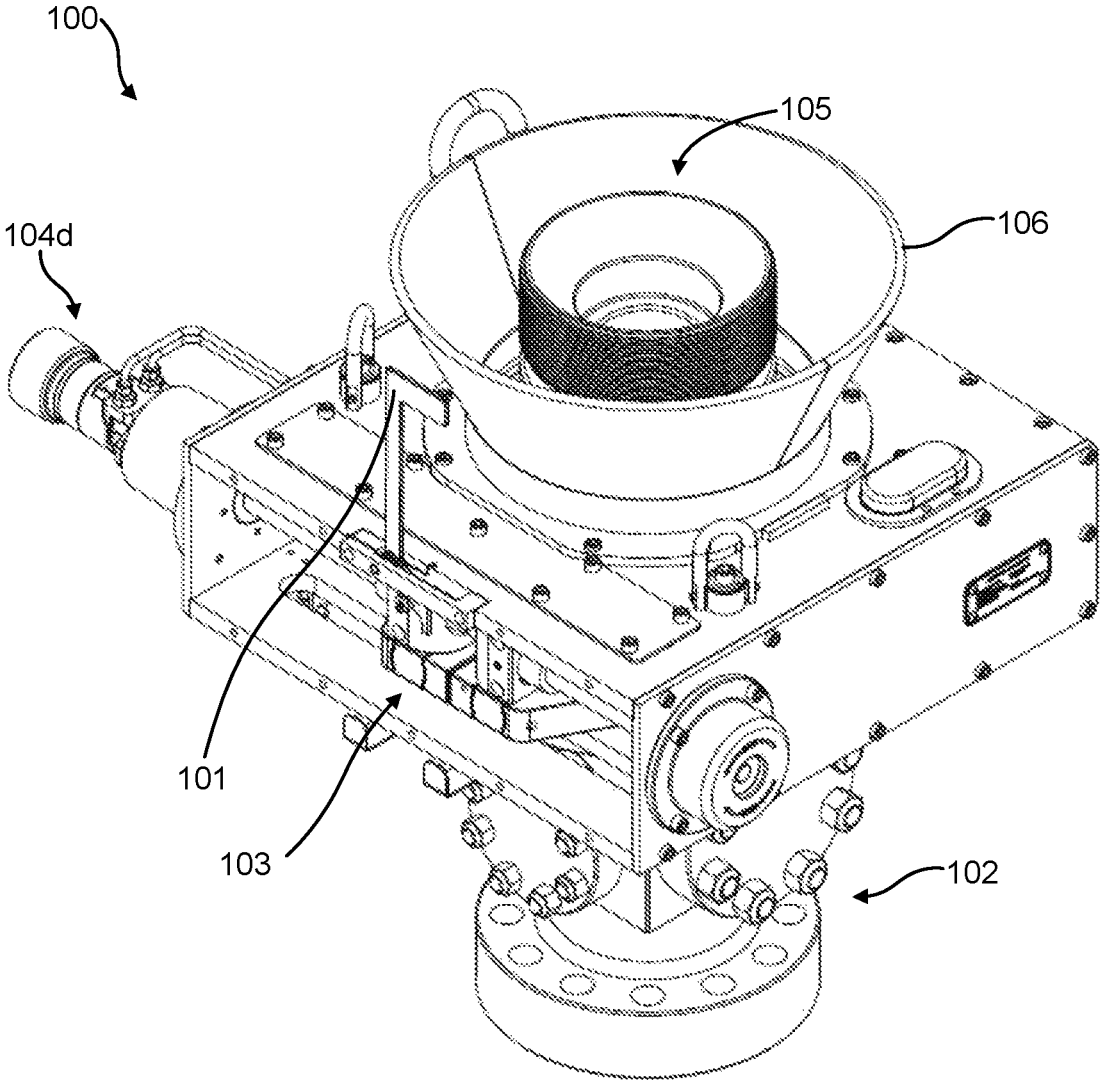
Figure 1G:
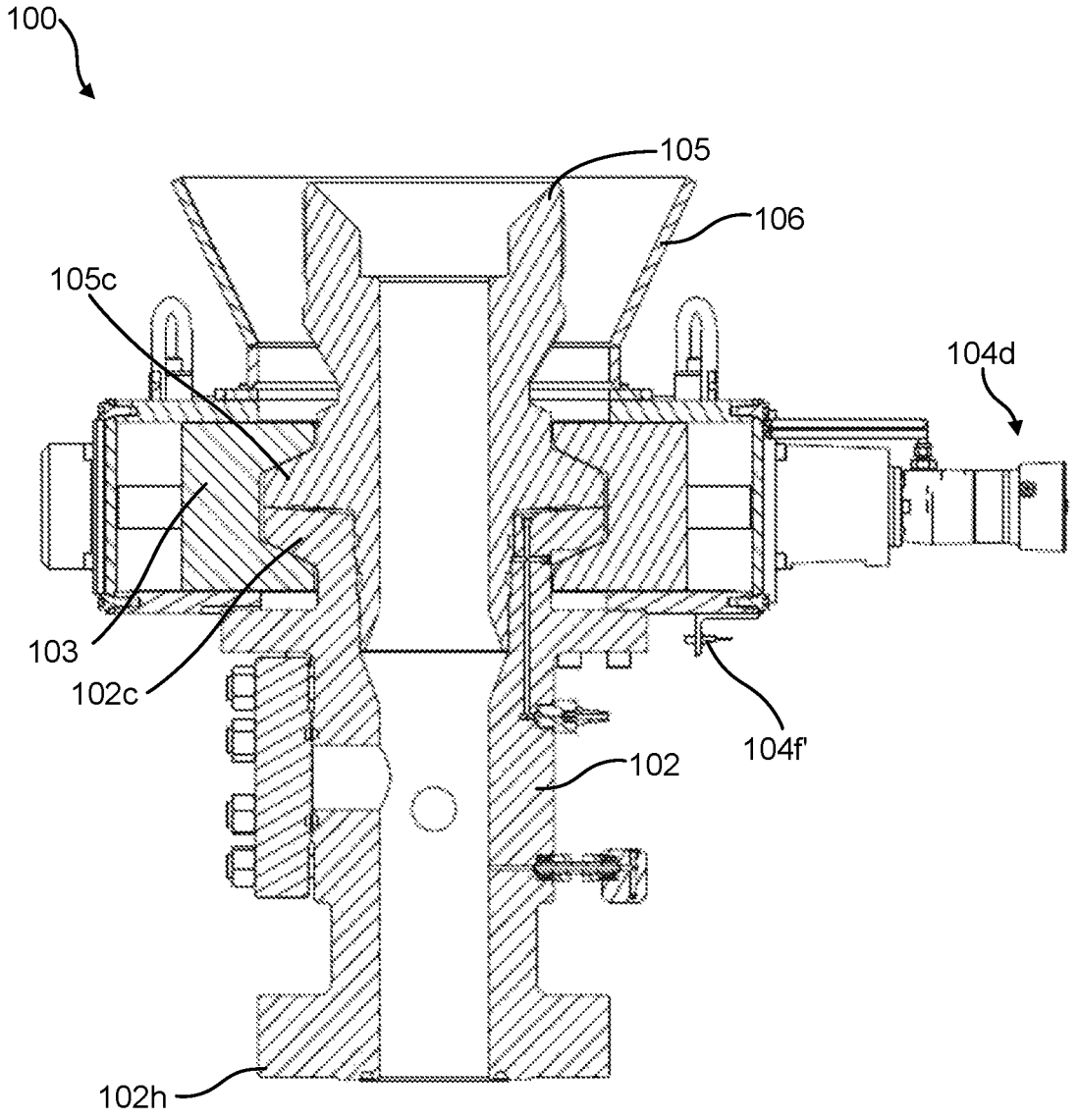

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112(f). Claims that include the "means for [function]" language but also recite the structure for performing the function are not means-plus-function claims governed by § 112(f). Claims that include the "step for [function]" language but also recite an act for performing the function are not step-plus-function claims governed by § 112(f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

An exemplary wellhead connection 100 is depicted in FIGS. 1A-1G. The wellhead connection 100 includes a flange assembly 102 that is connectable to a wellhead, a clamp 103 that is used to secure a crossover 105 to the flange assembly 102, and a clamp-control assembly 104 that is used to open and close the clamp 103. This wellhead connection 100 also includes a guide 106 to aid in positioning the crossover 105 for securing to the flange assembly 102 via clamp 103, a rigid flag 101 configured to be positioned "up" when the clamp 103 is fully closed and down when the clamp 103 is open, and a hydraulic-connector bracket 108 for attaching hydraulic lines to the wellhead connection 100. In operation, the crossover 105 connects pressure-control equipment (PCE) to the flange assembly 102, and thus to the wellhead.

Figure 2A:
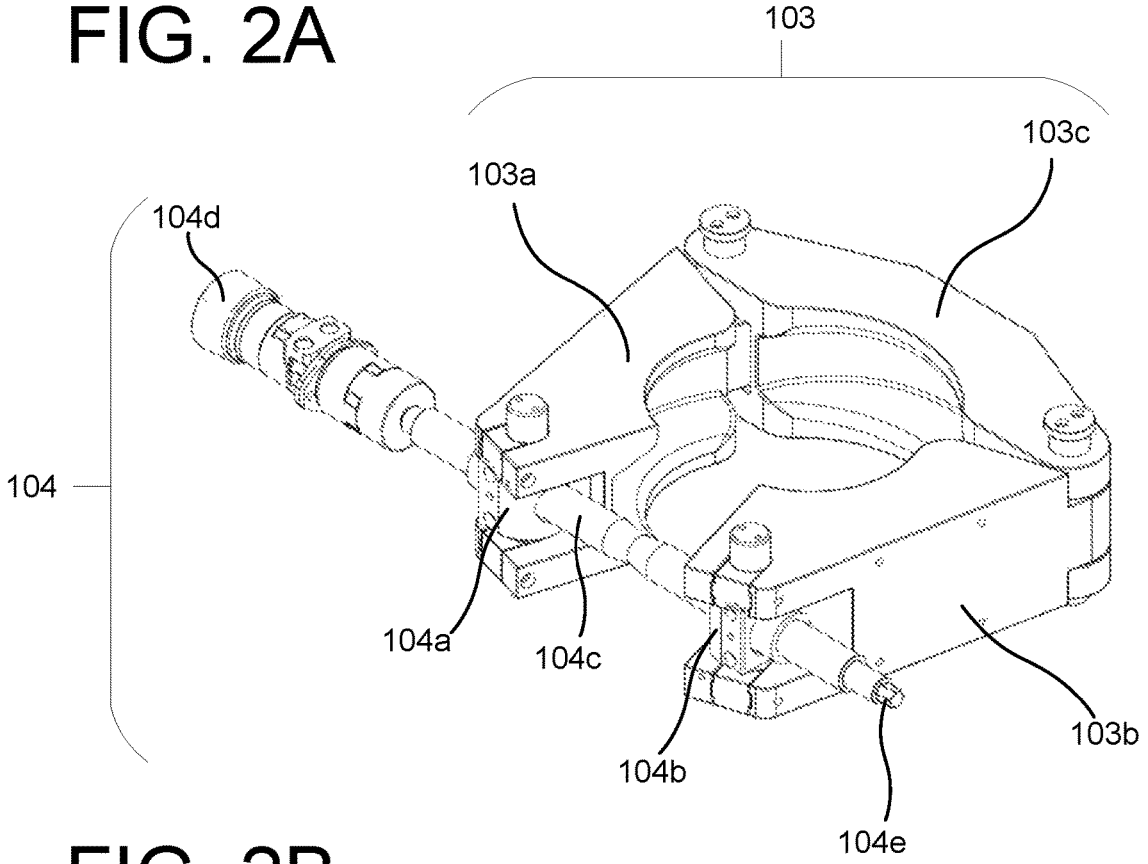
FIGS. 2A-2B are perspective and top views, respectively, of an exemplary clamp assembly of a wellhead connection according to an aspect of the invention.
Figure 2B:
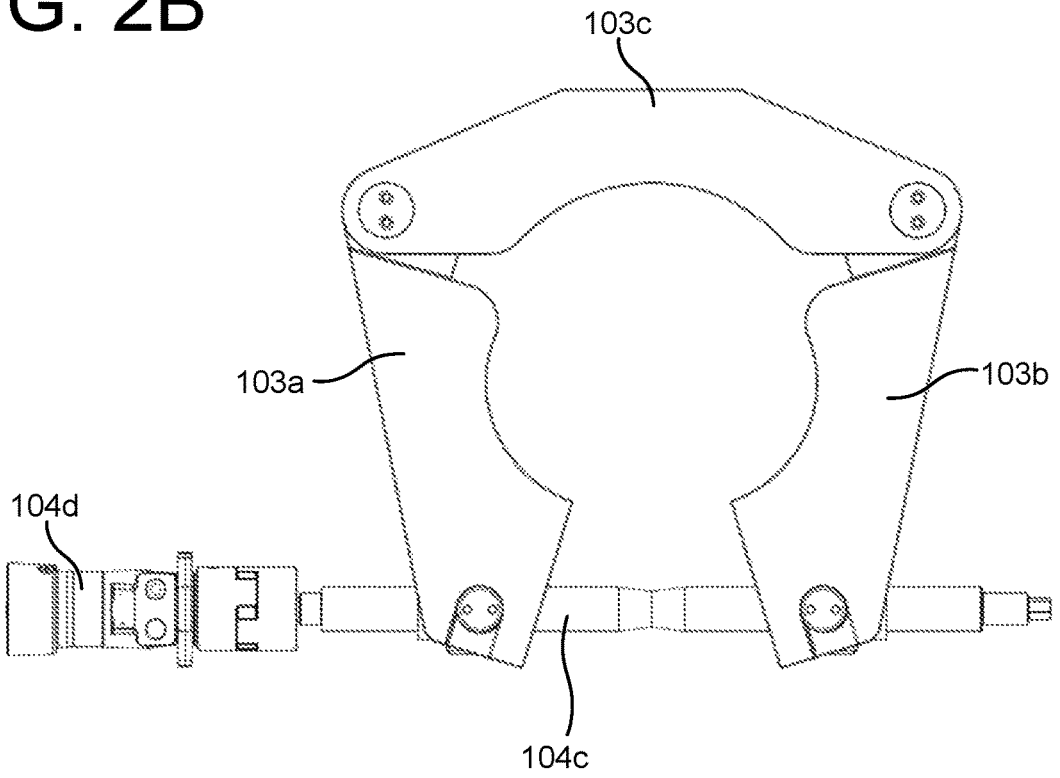
Figure 4A:
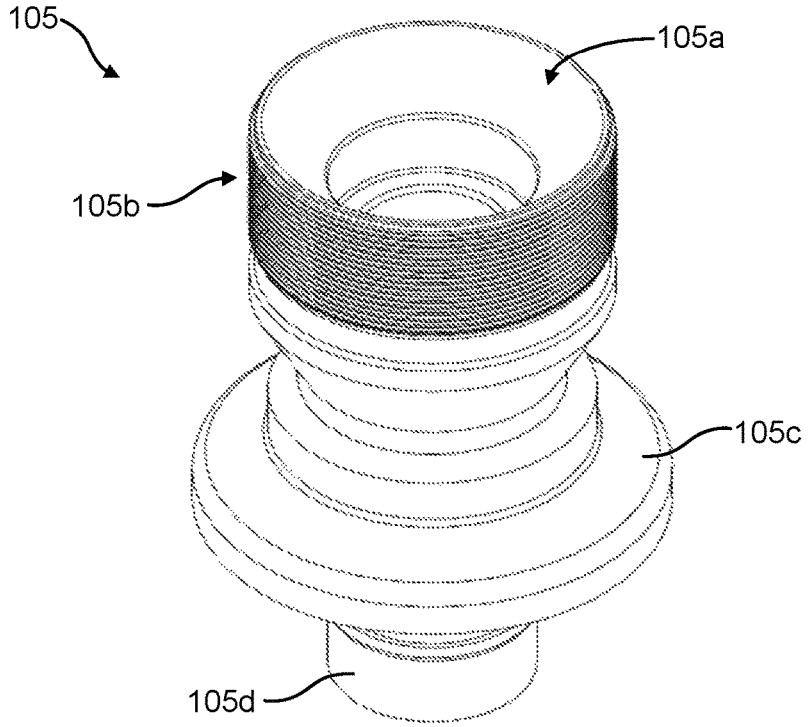
FIGS. 4A-4C are perspective, side, and side-sectional views, respectively, of an exemplary crossover configured for use as part of wellhead connection according to an aspect of the invention.
Figure 4B:
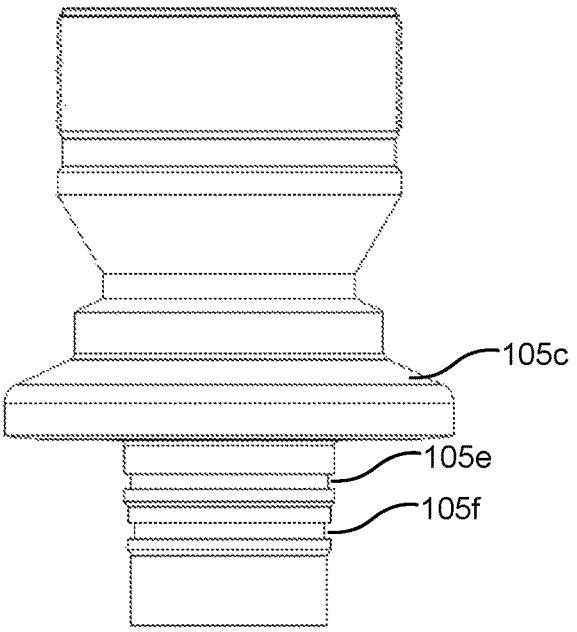
Figure 4C:
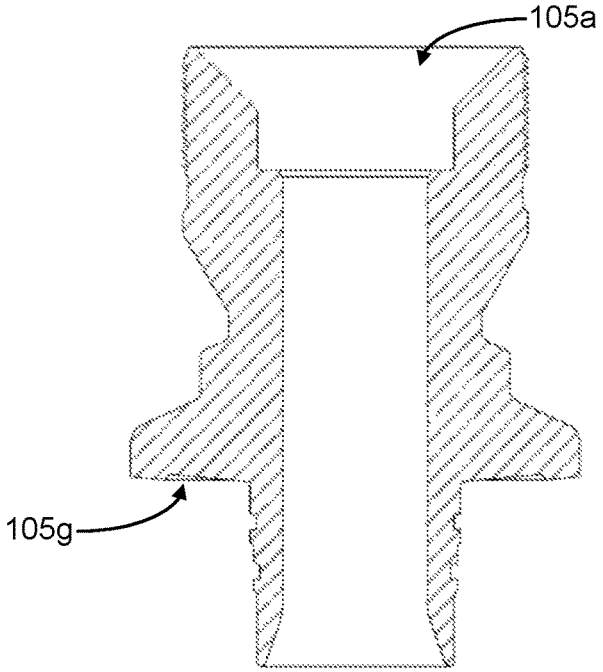
Figure 5A:
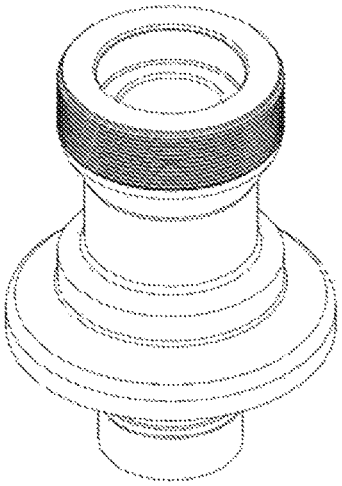
FIGS. 5A-5C are perspective, side, and side-sectional views, respectively, of an exemplary crossover configured for use as part of a wellhead connection according to an aspect of the invention.
Figure 5B:
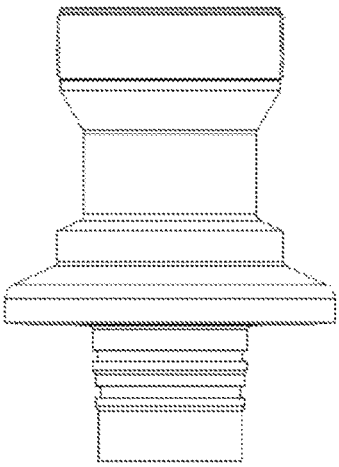
Figure 5C:
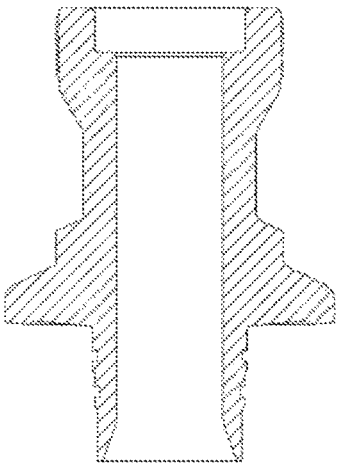
Figure 6A:
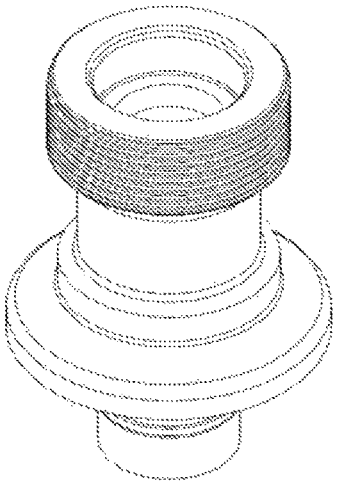
FIGS. 6A-6C are perspective, side, and side-sectional views, respectively, of an exemplary crossover configured for use as part of a wellhead connection according to an aspect of the invention.
Figure 6B:
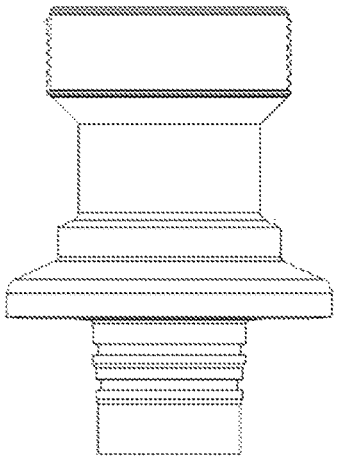
Figure 6C:
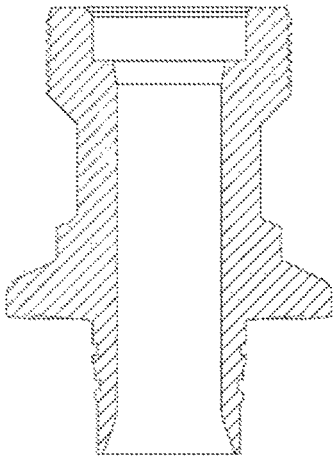
Figure 7A:
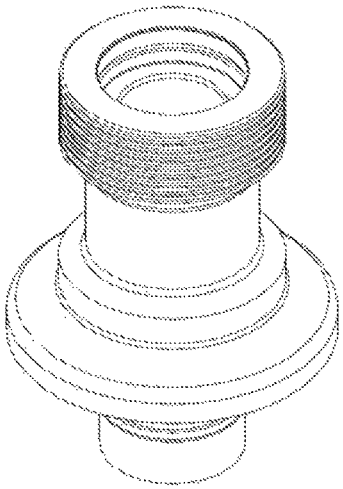
FIGS. 7A-7C are perspective, side, and side-sectional views, respectively, of an exemplary crossover configured for use as part of a wellhead connection according to an aspect of the invention.
Figure 7B:
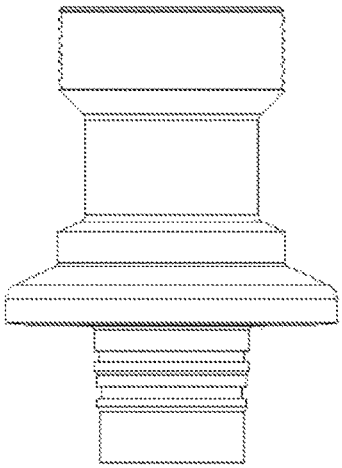
Figure 7C:
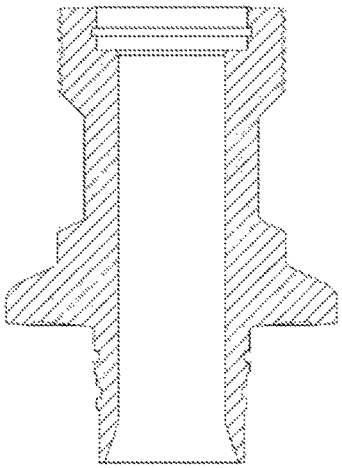
Figure 8A:
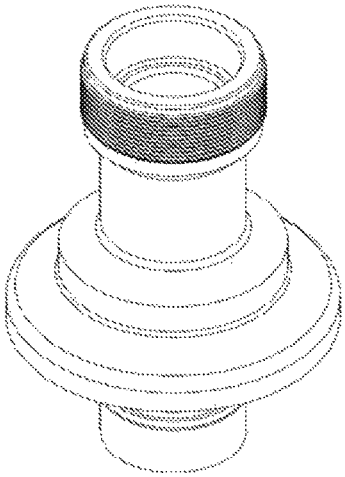
FIGS. 8A-8C are perspective, side, and side-sectional views, respectively, of an exemplary crossover configured for use as part of a wellhead connection according to an aspect of the invention.
Figure 8B:
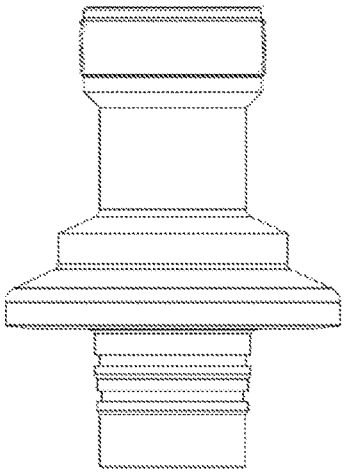
Figure 8C:
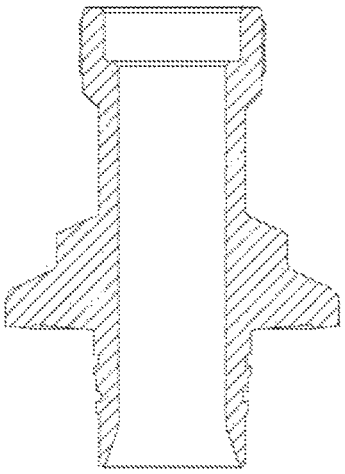
Figure 9A:
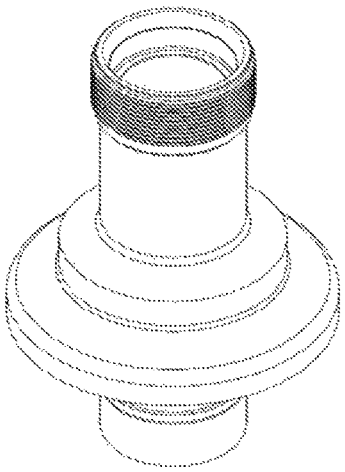
FIGS. 9A-9C are perspective, side, and side-sectional views, respectively, of an exemplary crossover configured for use as part of a wellhead connection according to an aspect of the invention.
Figure 9B:
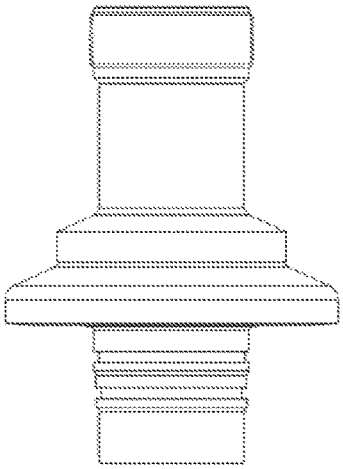
Figure 9C:
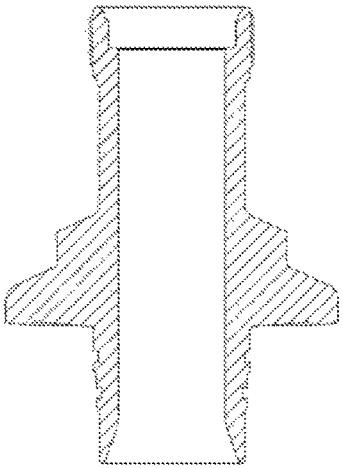
Figure 10A:
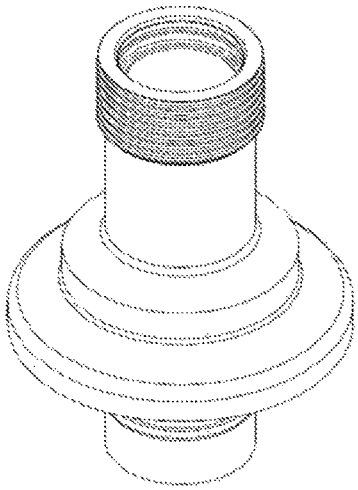
FIGS. 10A-10C are perspective, side, and side-sectional views, respectively, of an exemplary crossover configured for use as part of a wellhead connection according to an aspect of the invention.
Figure 10B:
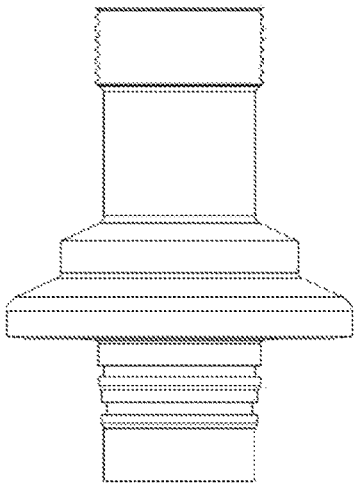
Figure 10C:
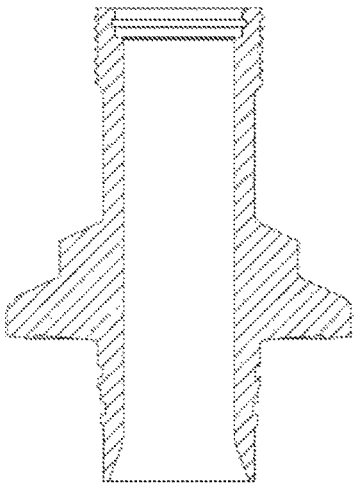
Figure 11A:
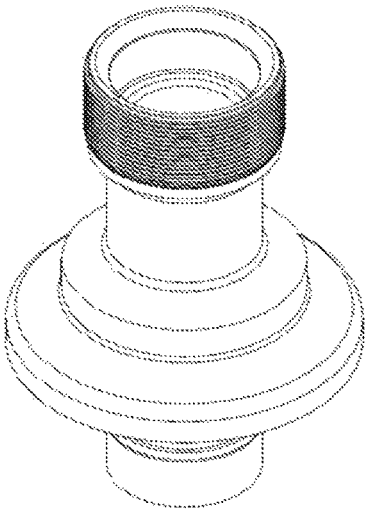
FIGS. 11A-11C are perspective, side, and side-sectional views, respectively, of an exemplary crossover configured for use as part of a wellhead connection according to an aspect of the invention.
Figure 11B:
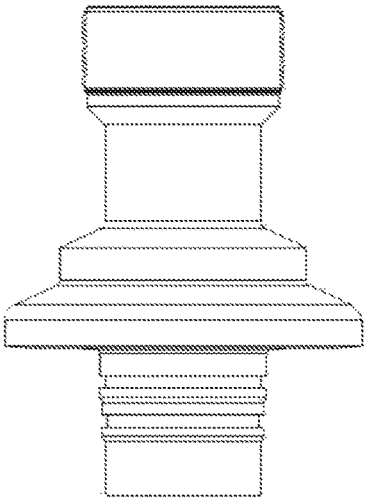
Figure 11C:
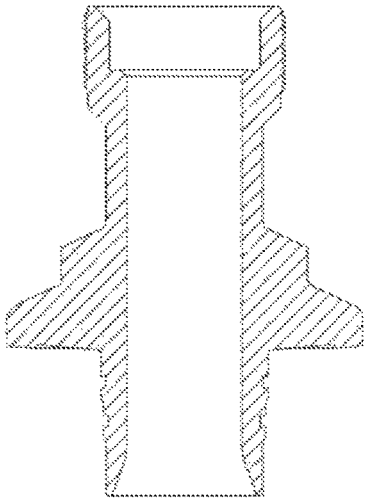
Figure 12A:
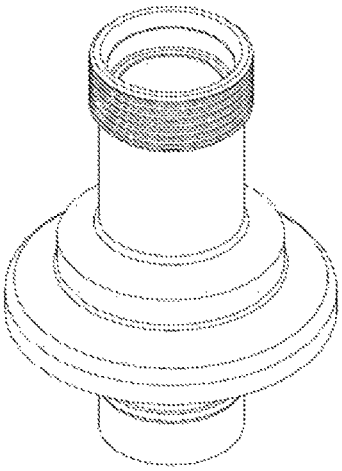
FIGS. 12A-12C are perspective, side, and side-sectional views, respectively, of an exemplary crossover configured for use as part of a wellhead connection according to an aspect of the invention.
Figure 12B:
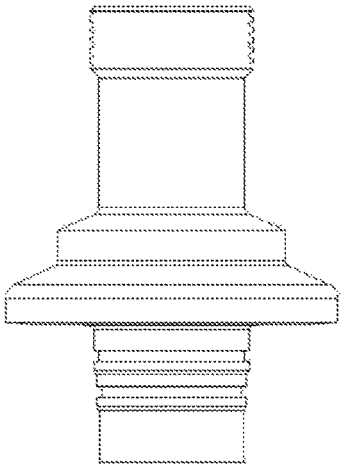
Figure 12C:
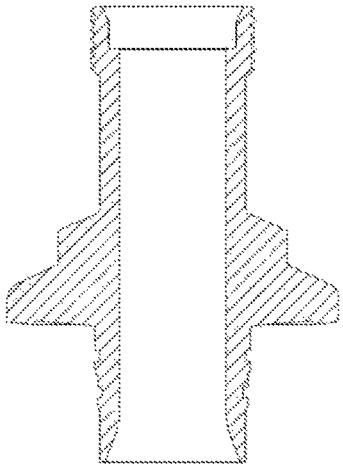
Figure 13A:
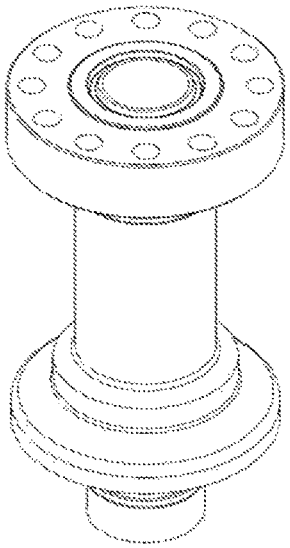
FIGS. 13A-13C are perspective, side, and side-sectional views, respectively, of an exemplary crossover configured for use as part of a wellhead connection according to an aspect of the invention.
Figure 13B:
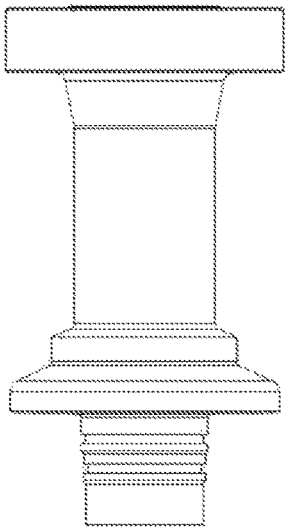
Figure 13C:
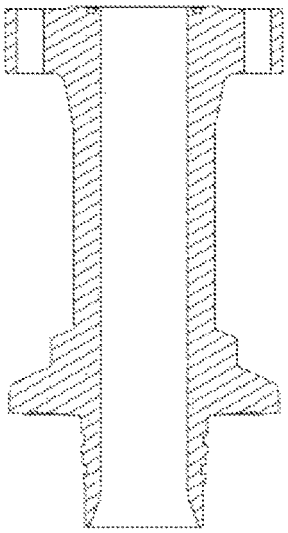
Figure 14A:
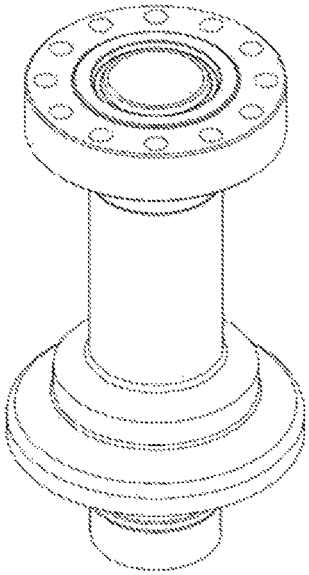
FIGS. 14A-14C are perspective, side, and side-sectional views, respectively, of an exemplary crossover configured for use as part of a wellhead connection according to an aspect of the invention.
Figure 14B:
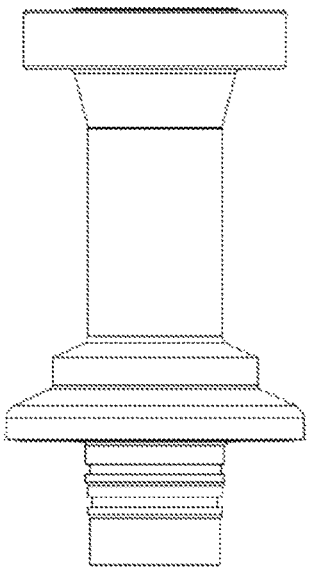
Figure 14C:
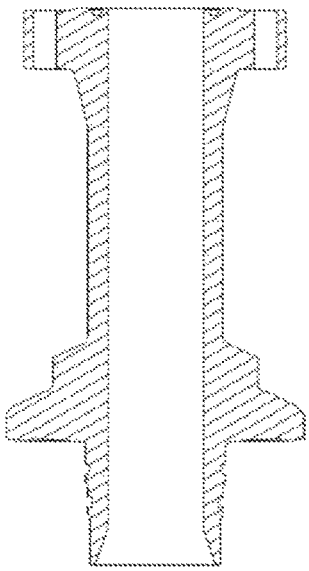
Figure 15A:
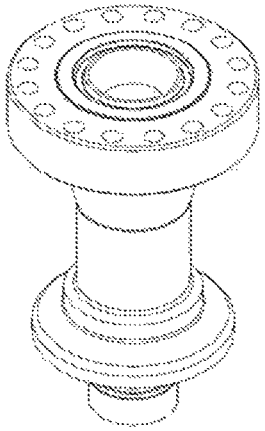
FIGS. 15A-15C are perspective, side, and side-sectional views, respectively, of an exemplary crossover configured for use as part of a wellhead connection according to an aspect of the invention.
Figure 15B:
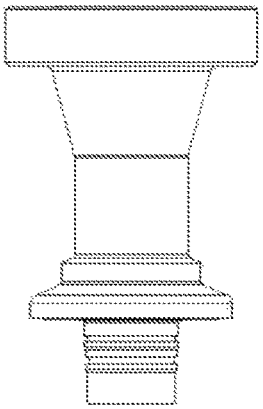
Figure 15C:
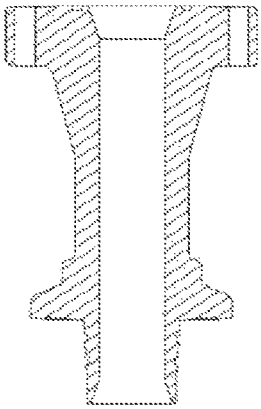

The clamp 103 and clamp-control assembly 104 can be understood with reference to FIGS. 2A and 2B. The clamp 103 includes three pivotally-connected segments 103*a*, 103*b*, 103*c*. The clamp segments each include a surface configured to simultaneously engage a clamp hub 102*c* on the flange assembly 102 and a clamp hub 105*c* on the crossover 105. Detail of the flange assembly 102 is depicted in FIGS. 22A-22F, as described below. Detail of the crossover 105 is depicted in FIGS. 4A-4C, as described below.

The clamp-control assembly 104 includes a hydraulic motor 104*d* configured to rotate a screw-threaded shaft 104*c*. The threaded shaft 104*c* is threaded through two screw-threaded positioning units 104*a*, 104*b*. The direction and speed of rotation of the threaded shaft 104*c* is controlled through variance of hydraulic pressure to the motor 104*d*. When the shaft 104*c* is rotated in one direction (e.g., clockwise), the positioning units 104*a*, 104*b* travel along the shaft 104*c* toward each other. In this twin-screw embodiment, the first positioning unit 104*a* has the opposite thread direction from the second positioning unit 104*b* (e.g., the first unit 104*a* has a left-hand thread and the second unit 104*b* has a right-hand thread). When the shaft 104*c* is rotated in a second, opposite, direction (e.g., counterclockwise), the positioning units 104*a*, 104*b* travel along the shaft apart from each other. The positioning units 104*a*, 104*b* are connected to two clamp segments 103*a*, 103*b* such that when the positioning units 104*a*, 104*b* travel along the shaft 104*c* toward each other, the clamp 103 closes. And when the positioning units 104*a*, 104*b* travel along the shaft 104*c* apart from each other, the clamp 103 opens. Thus, selective application of hydraulic pressure to the hydraulic motor 104*d* can be used to selectively position the clamp 103 in the open or closed position. The shaft 104*c* may be configured with a wrench surface 104*e* to enable manual rotation of the shaft. The clamp-control assembly 104 may be further configured with a sensor 104*f* (e.g., a magnetic position or proximity sensor) to provide a signal to identify whether (or not) the clamp 103 is fully closed or fully opened. The clamp-control assembly 104 may include a hydraulic brake to maintain the clamp in position if hydraulic pressure is removed from the motor.

Figure 1H:
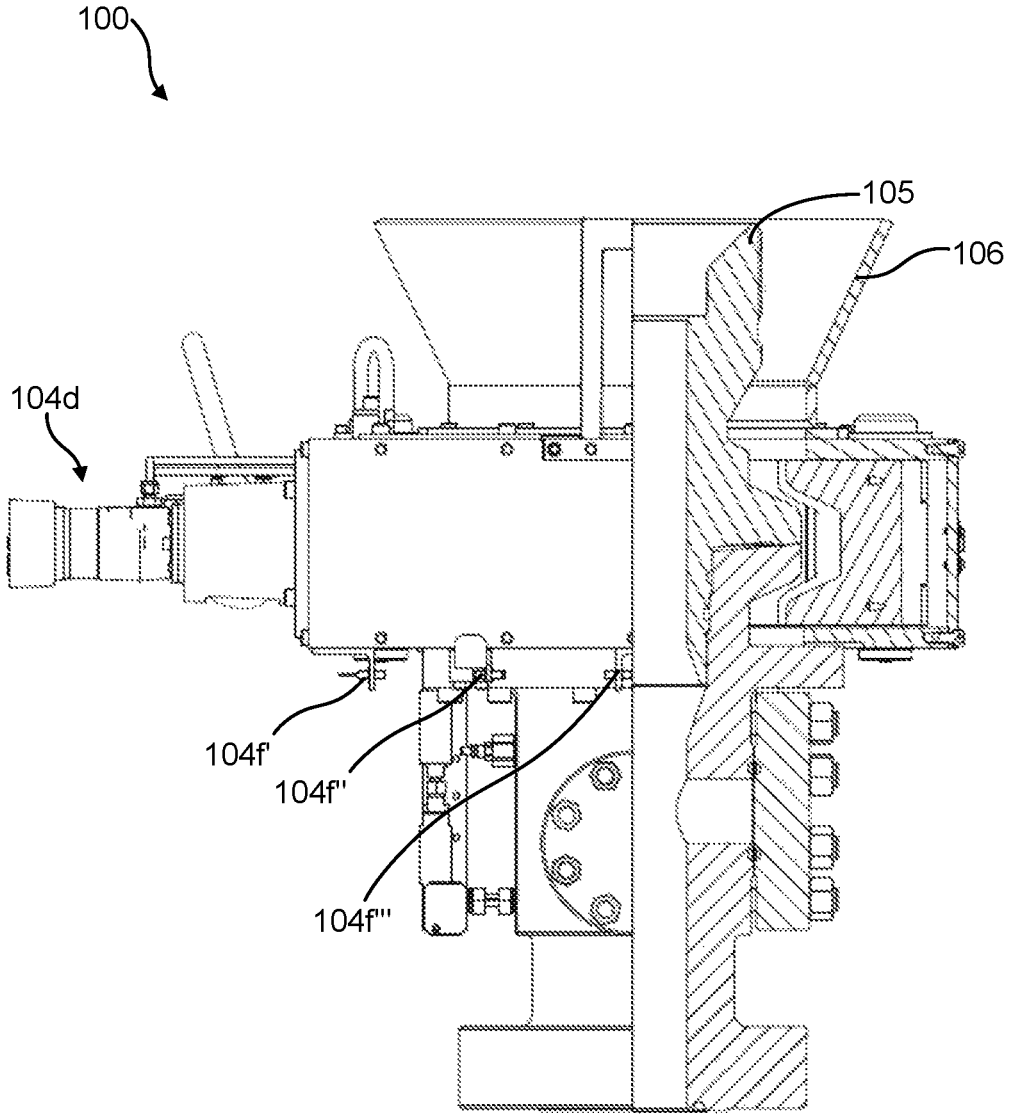
Figure 3A:
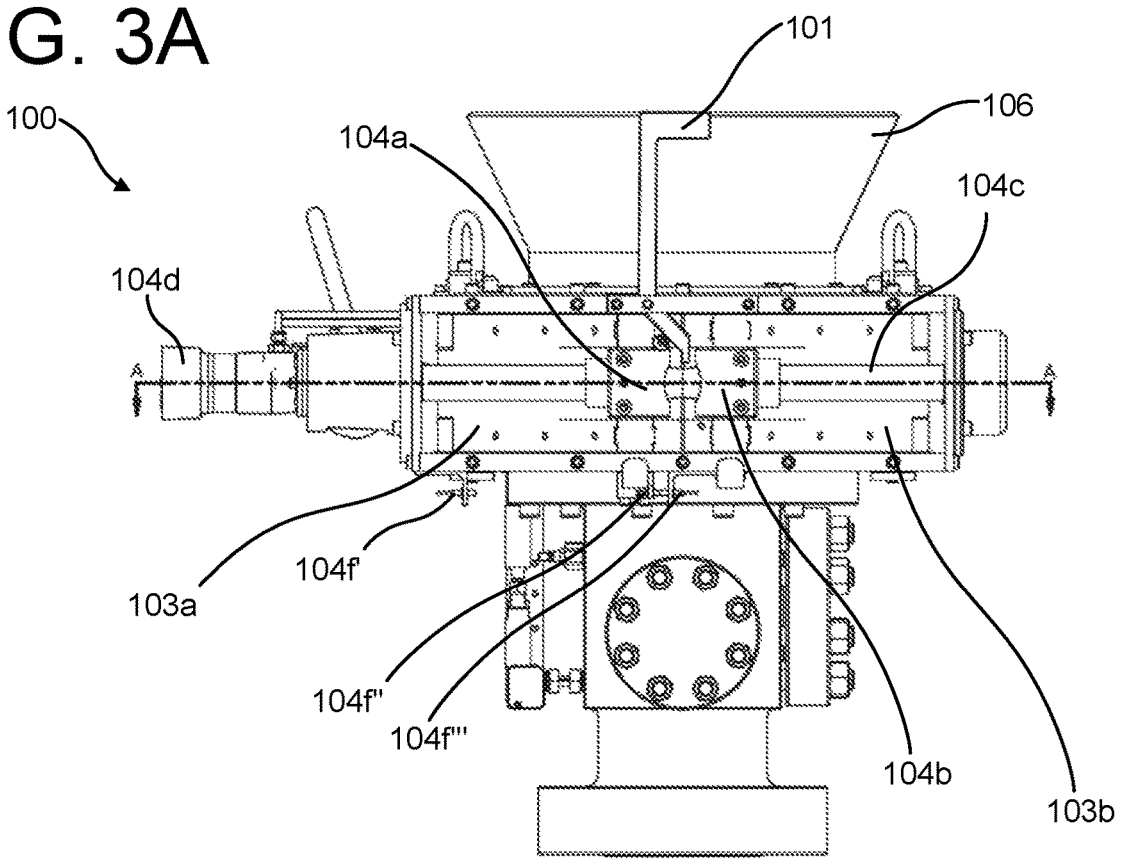
FIGS. 3A-3B are a side and top-sectional views, respectively, of a clamp assembly in a "clamped" or "closed" position and disposed in an exemplary wellhead connection according to an aspect of the invention.
Figure 3B:
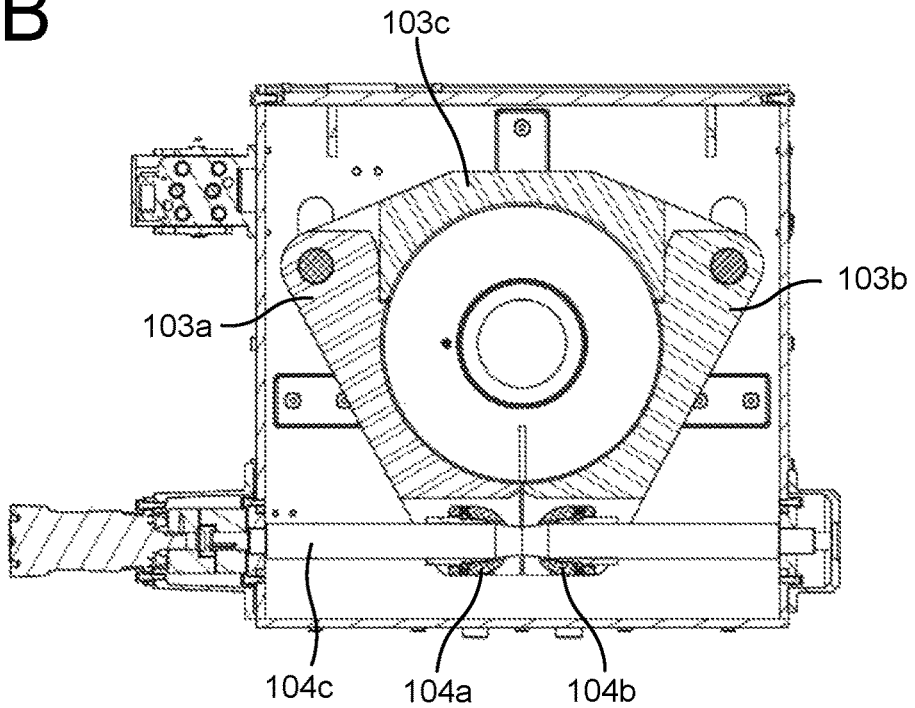
Figure 3C:
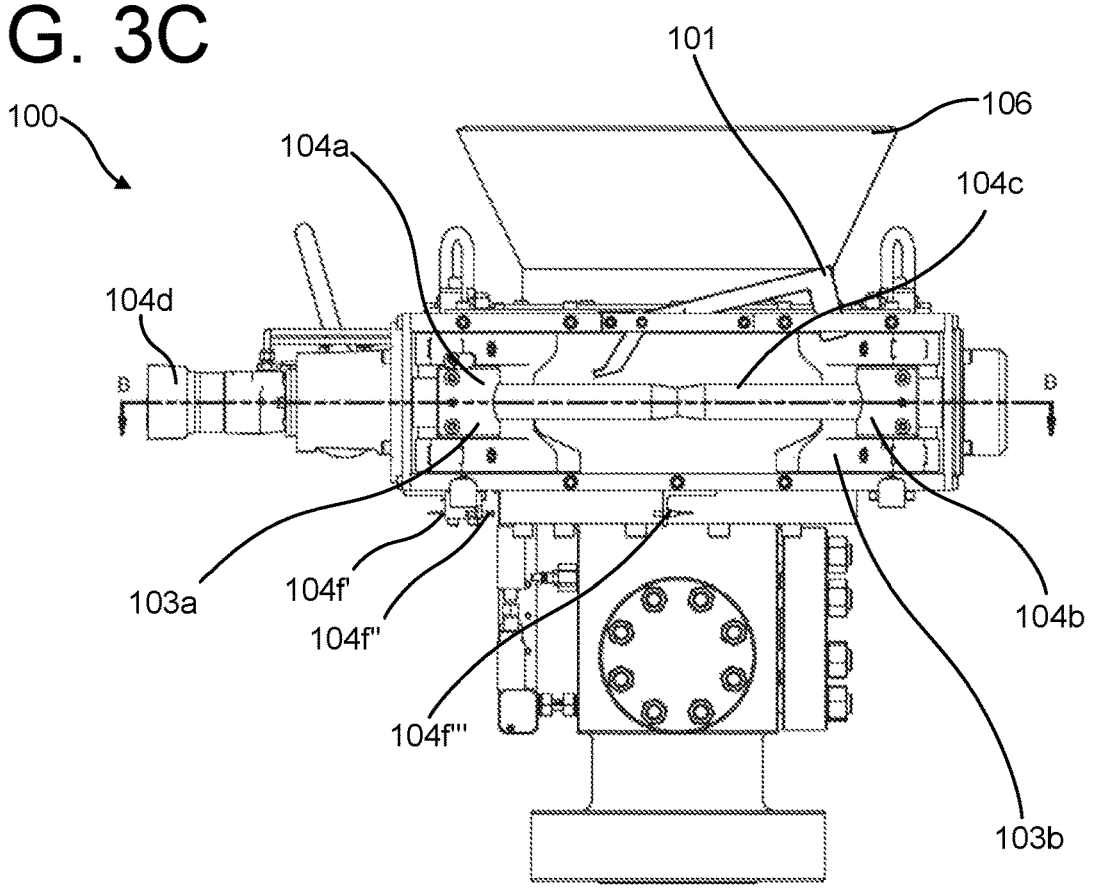
FIGS. 3C-3D are a side and top-sectional views, respectively, of a clamp assembly in an "unclamped" or "open" position and disposed in an exemplary wellhead connection according to an aspect of the invention.

As depicted in FIGS. 1H, 3A, and 3C, a magnetic (or other) sensor 104*f* can be disposed to provide an operator with an electronic indication of the state of the clamp 103. For example, the sensor 104*f* may be disposed on clamp segments 103*a*, 103*b* or the positioning units 104*a*, 104*b* to register their proximity one to the other. The signal provided by the sensor 104*f* when the clamp segments 103*a*, 103*b* or positioning units 104*a*, 104*b* once the positioning units 104*a*, 104*b* have traveled the full extent toward each other indicates that the clamp 103 is fully closed or open.

In the exemplary embodiment depicted in FIG. 1H (a partial sectional view of the wellhead connection 100 with the clamp 103 in a partially-opened position), 3A (a front view of the wellhead connection 100 with the clamp 103 in the fully-opened position), and 3C (a front view of the wellhead connection 100 with the clamp 103 in the fully-closed position), the sensor 104*f* includes two reed switches 104*f*', 104*c*" and a magnetic actuator 104*f*". The reed switches are installed on the wellhead connection 100 such that they do not move with the clamp 103 (e.g., on the surface of a clamp enclosure). The magnetic actuator 104*f*" is installed on a positioning unit 104*a* or clamp segment 103*a* such that when the clamp is fully opened, the actuator 104*f*" magnetically engages the first reed switch 104*f*' (left in the drawing) to provide a "fully opened" signal to a controller. When the clamp is fully closed, the actuator 104*f*" magnetically engages the second reed switch 104*f*"' (right in the drawing) to provide a "fully closed" signal to the controller. That is, a signal from the first reed switch 104*f*' indicates the clamp 103 is in the fully-opened position and a signal from the second reed switch 104*c*" indicates the clamp 103 is in the fully-closed position. Equivalently, other proximity or position sensors may be use (e.g., acoustic sensors, infrared or light sensors, microswitches, LVDTs, DVRTs, Hall-effect sensors). As explained below, the clamp-position sensor 104*f* may be used to provide feedback to the wellhead-connection operator and as part of a safety interlock to prevent/enable select connection operations based on clamp position.

Figure 3D:
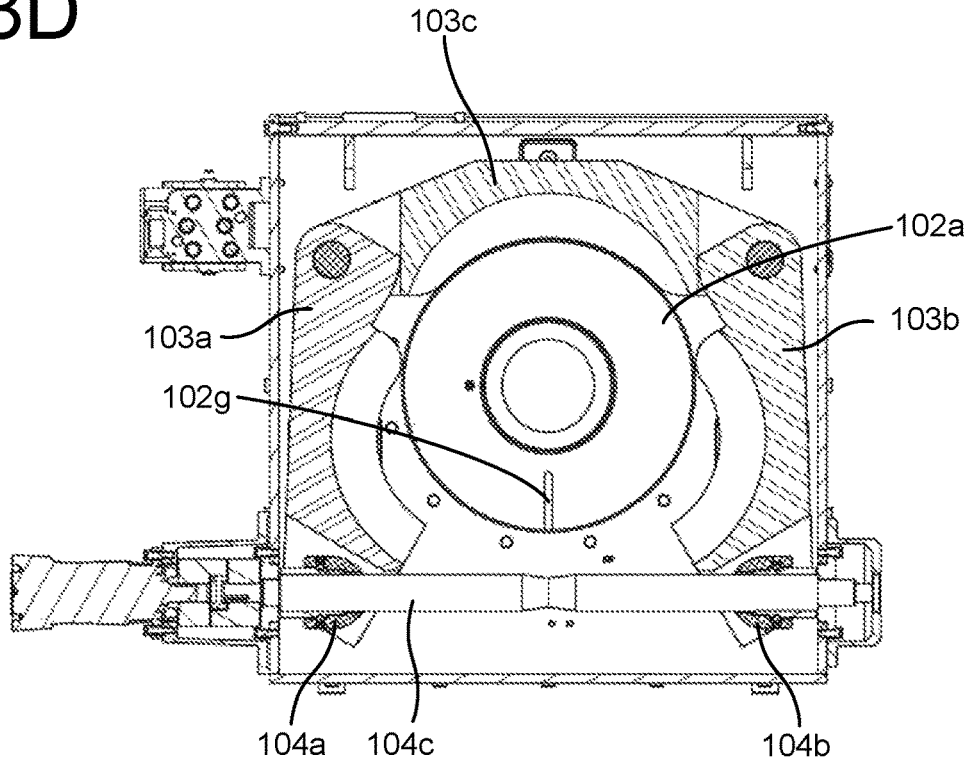

FIGS. 3A-3D depict detail of the clamp 103 and clamp-control assembly 104 disposed within (and as part of) the wellhead connection 100 (shown without the crossover 105 for sake of clarity). In FIGS. 3A and 3B, the clamp 103 is depicted as fully closed. In this closed configuration, the motor 104*d* has been operated until positioning units 104*a*, 104*b* have traveled the full extent toward each other causing two clamp segments 103*a*, 103*b* to pivot with respect to the third segment 103*c* to "close" the clamp 103. In FIGS. 3C and 3D, the clamp 103 is depicted as fully open. In this fully-open configuration, the motor 104*d* has been operated until positioning units 104*a*, 104*b* have traveled the full extent away from each other causing two clamp segments 103*a*, 103*b* to pivot with respect to the third segment 103*c* to "open" the clamp 103. Through mechanical contact with a clamp segment 103*a*, the clamp-position flag 101 is configured to pivot to an up position when the clamp 103 is fully closed (as shown in FIG. 3A) and to a down position when the clamp 103 is even partially open (as shown in FIG. 3C). The flag 101 enables an operator to visually determine the state of the clamp 103 while remaining remote from the wellhead connection 100.

The connection between the flange assembly 102 and crossover 105 can be better understood with reference to FIGS. 4A-4C and 22A-22F. An exemplary crossover 105 is depicted in FIGS. 4A-4C. The crossover 105 includes an upper connection 105*b* for connecting to PCE and a lower connection 105*c*/105*d* for connecting to a flange assembly 102. The lower connection 105*c*/105*d* includes a pin 105*d* configured to fit in a receptacle 102*d* in the flange assembly 102 and a hub 105*c* (or ridge) configured to mate with the clamp 103. The crossover 105 may include an entry guide 105*a* to guide tools lowered into the well through the wellhead connection 100 during pressure-control operations on the well. The flange assembly includes a lower connection 102*h* for connecting to a wellhead (directly or through intervening equipment) and an upper connection 102*c*/102*d* for connecting to a crossover 105. The upper connection includes a receptacle 102*d* configured to accept the pin 105*d* of the crossover 105 and with a hub 102*c* configured to mate with the clamp 103.

In operation, the pin 105*d* of the crossover 105 is inserted into the receptacle 102*d* of the flange assembly 102. The pin 105*d* includes mechanisms (e.g., O-rings in grooves (or glands) 105*e*, 105*f*) to create a circumferential seal between the pin 105*d* and the flange assembly 102 for operation at a predetermined conditions primarily based on wellhead pressure (e.g., 10 kpsi over atmospheric pressure). The seal mechanism is pressure-dependent, different pressures require different seal designs or materials. And the seal mechanisms may also vary depending on fluids in the wellbore or temperature at the wellhead. For example, a different material or cross-sectional shape of the O-ring may be required for sour gas or higher temperatures.

When the pin 105*d* is inserted into the receptacle 102*d* of the flange assembly 102, the hub face 105*g* of the crossover 105 engages the hub face 102*a* of the flange assembly 102. The clamp 103 is configured to simultaneously engage the crossover's hub 105*c* and the flange assembly's hub 102*c* such that when the clamp 103 is closed, the clamp 103 holds the crossover 105 and flange assembly 102 together. It does this by exerting a force on the crossover's hub 105*c* and the flange assembly's hub 102*c* in reaction to any force pushing the assembly 102 and crossover 105 apart (e.g., due to wellhead pressure greater than the ambient pressure). Thus, the clamp 103 secures the crossover 105 to the flange assembly 102 to hold a sealed connection under pressure.

The hub face 105*g* of the crossover 105 or the hub face 102*a* of the flange assembly 102 may include a debris groove. Because the engagement between the crossover hub face 105*g* and the flange-assembly hub face 102*a* does not create a seal (it is designed to not create a seal), the contact between the hub faces 105*g*, 102*a* does not need to be uniform. A debris groove allows that debris build-up (e.g., ice) between the hub faces 105*g*, 102*a* will not necessarily prevent the hub faces 105*g*, 102*a* from mating sufficiently such that the seal(s) between the pin 105*d* and the receptacle 102*d* surface remain. That is, the seal(s) allow for some separation between the hub faces 105*g*, 102*a*. And the debris groove allow a certain level of debris build-up between the hub faces 105*g*, 102*a* before the hub faces 105*g*, 102*a* are separated beyond what is acceptable for the seal(s).

The flange-assembly hub face 102*a* may further provide a leak-detection groove 102*b*. This groove facilitates detection of a failure of the seal between pin 105*d* and flange-assembly receptacle 102*d* by providing a preferential path for the leaking fluids. The leak-detection groove 102*b* is preferentially oriented for convenient view of the operator (e.g., directly below the flag 101). If the seal(s) are leaking, the fluid will appear at the groove 102*b* such that the operator may see it without having to inspect the entire circumference of the flange-assembly/crossover connection. Alternatively, the leak-detection groove may be provided in the hub face of the crossover.

A crossover may be configured with any upper connection (105*b* in the exemplary crossover 105) suitable for connecting to any of a variety of PCE and may be configured for operation at different wellhead pressures. Some examples of crossover variants are depicted in FIGS. 5A-15C. FIGS.

5A-12C depict crossover with threaded connections to PCE and FIGS. 13A-15C depict crossovers with bolted connections to PCE. The common characteristic of these exemplary crossovers, regardless of the upper connection, is that the crossover connects to the flange assembly 102 as described with reference to the exemplary crossover 105 depicted in FIGS. 4A-4C.

Figure 19:
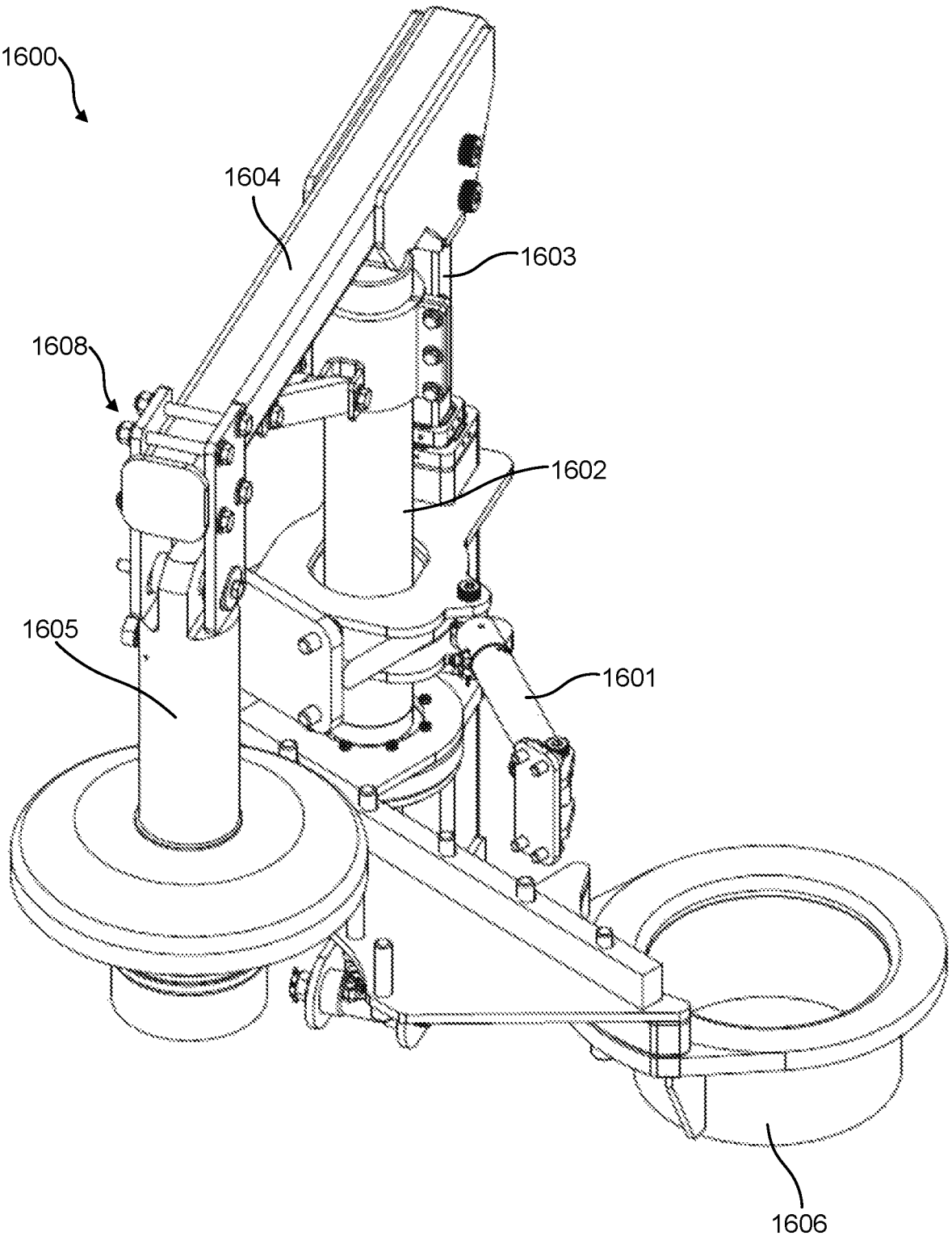
FIG. 19 is a perspective view of an exemplary nightcap extractor according to an aspect of the invention.

An exemplary wellhead connection 100* is depicted in FIGS. 16A-16F with an exemplary nightcap extractor 1600 (the nightcap extractor 1600 is shown separated from the rest of the wellhead connection 100* in FIG. 19). The exemplary nightcap extractor 1600 includes a horizontal support arm 1604 connected to a vertical support arm 1603. (In the depicted embodiment, the horizontal support arm 1604 is fixed at roughly 90 degrees to the vertical support arm 1603. Alternatively, the horizontal support arm 1604 may be connected to the vertical support arm 1603 such that it may pivot or such that it is fixed at other angles.) The vertical support arm 1603 may rotate relative to the wellhead connection such that the horizontal support arm 1604 may be positioned over the wellhead connection or away from the wellhead connection. The horizontal support arm 1604 may move vertically relative to the flange assembly 102 (e.g., it may pivot relative to the vertical support arm 1603 or it may telescopically extend relative to the flange assembly). The rotational position of the vertical support arm 1603 is controlled by a hydraulic cylinder 1601. The vertical or "lift" position of the horizontal support arm 1604 relative to the flange assembly 102 is controlled by a hydraulic cylinder 1602. The nightcap extractor 1600 is used to position a nightcap 1605. FIG. 19 depicts the nightcap extractor 1600 as separated from the wellhead connection 100*.

Figure 16A:
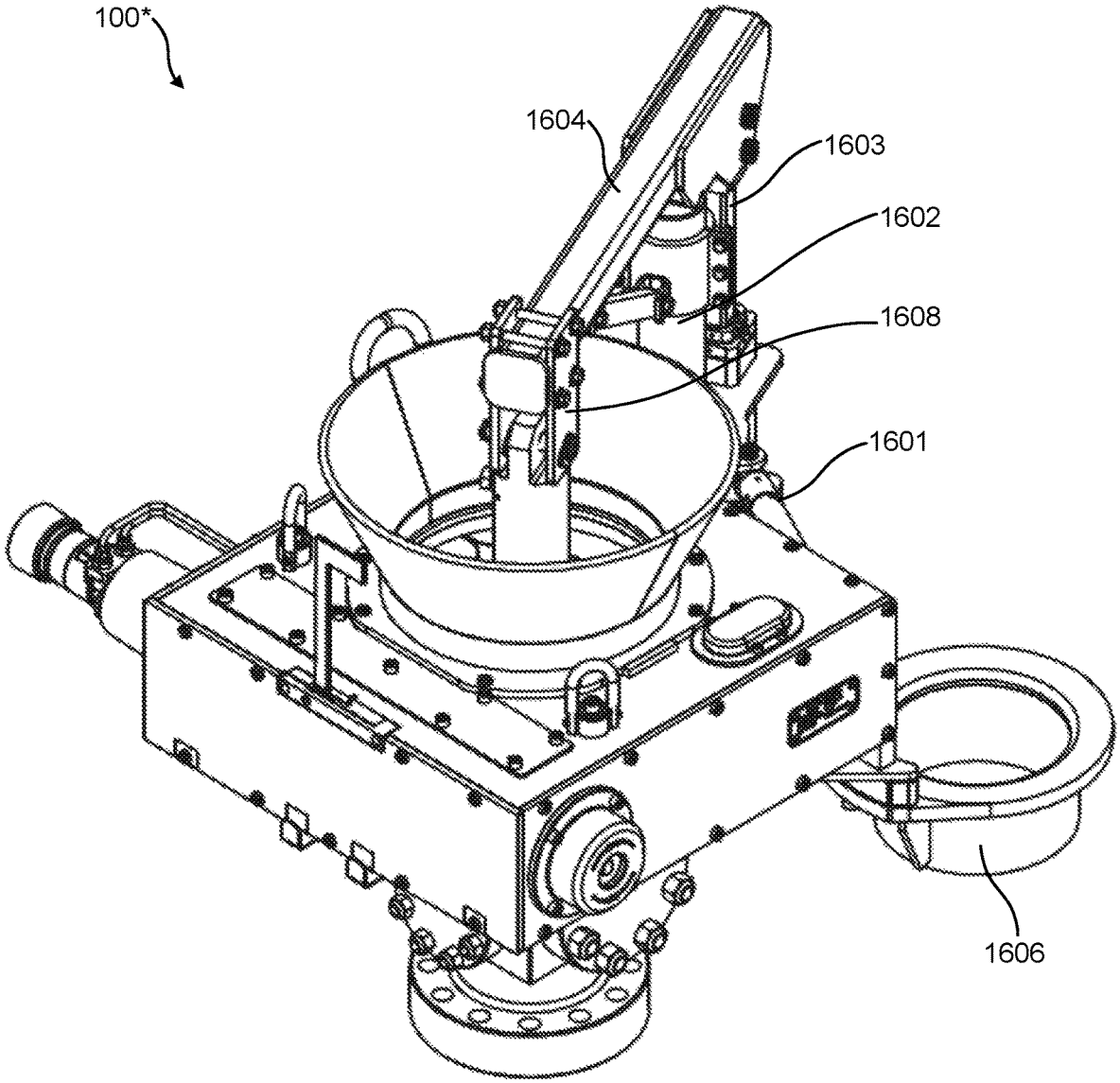
FIGS. 16A-16F are various views of an exemplary wellhead connection with an exemplary nightcap extractor according to an aspect of the invention.
Figure 16B:
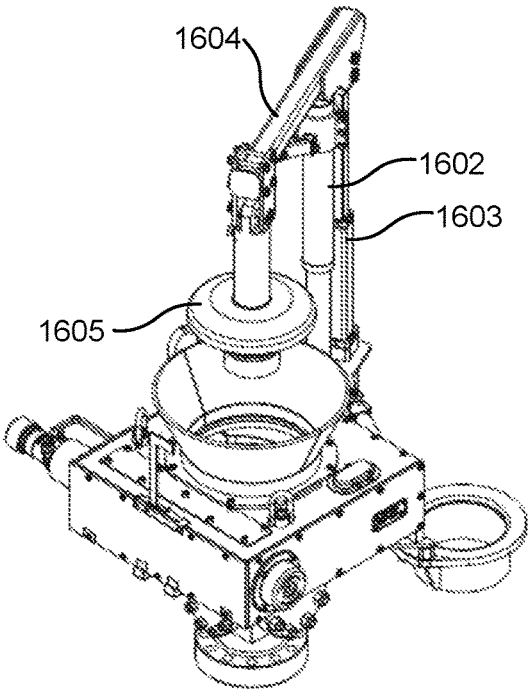
Figure 16C:
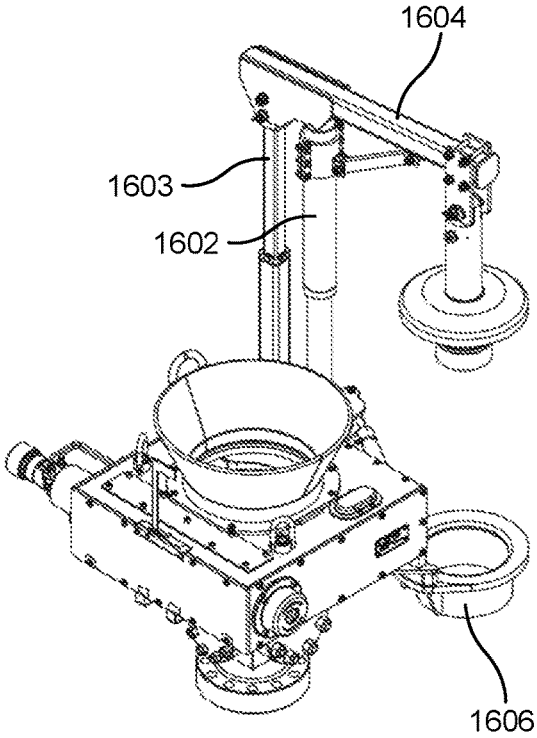
Figure 16D:
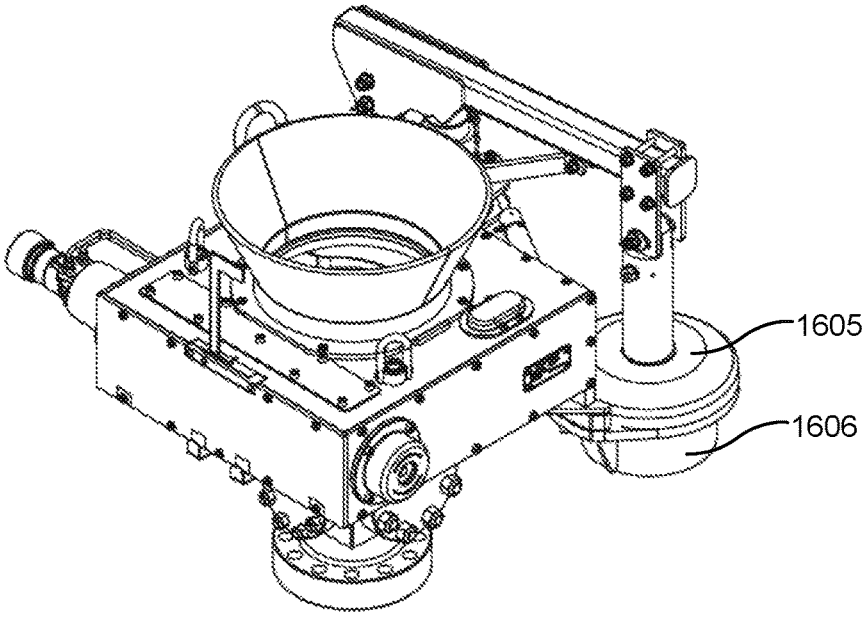
Figure 16E:
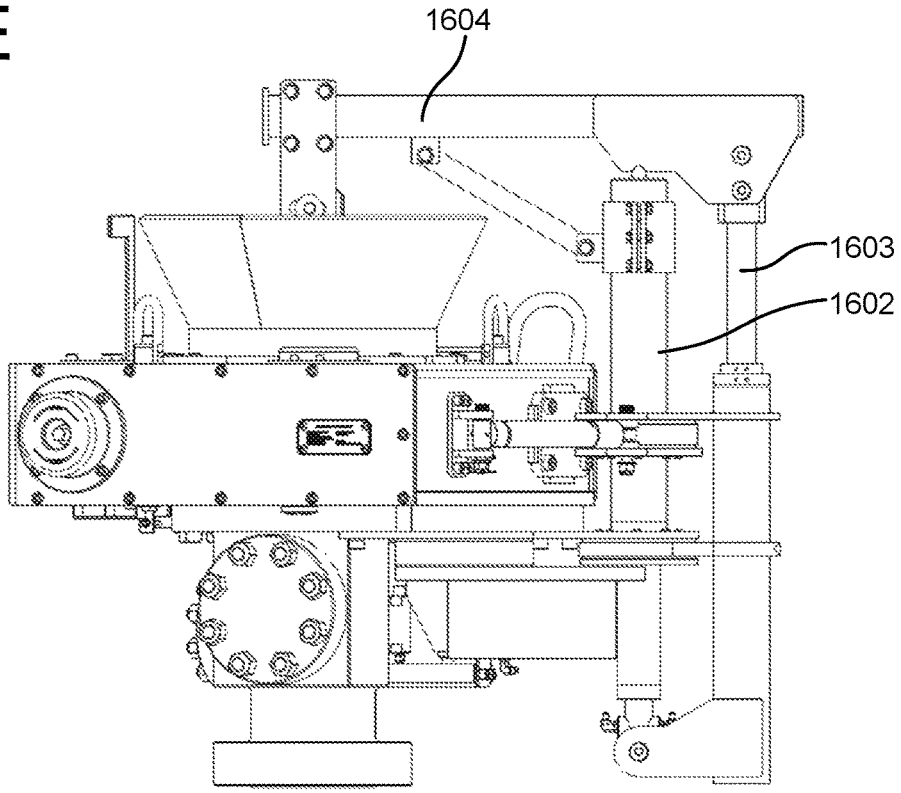
Figure 16F:
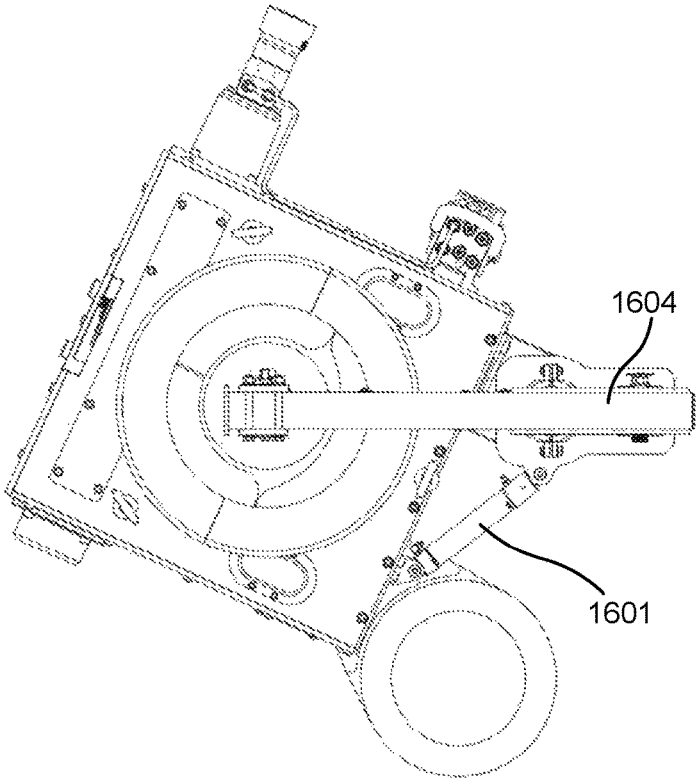

The operation of the exemplary nightcap extractor 1600 can be understood with reference to FIGS. 16A-16D. In FIG. 16A, the nightcap extractor 1600 has placed the nightcap 1605 in position to be secured in place by the clamp 103. The horizontal support arm 1604 is in the nightcap-down position and its controlling hydraulic cylinder 1602 is retracted, and the vertical support arm 1603 is in the rotate-over position and its controlling hydraulic cylinder 1601 is retracted. In FIG. 16B, the nightcap extractor 1600 is supporting a nightcap 1605 with the horizontal support arm 1604 in the nightcap-up position and the vertical support arm 1603 in the rotate-over position. In this nightcap-up/rotate-over position, the hydraulic cylinder 1602 controlling the lift position is extended and the hydraulic cylinder 1601 controlling the rotation position is retracted. In FIG. 16C, the nightcap extractor 1600 is supporting a nightcap 1605 with the horizontal support arm 1604 in the nightcap-up position and the vertical support arm 1603 in the rotate-away position. In this nightcap-up/rotate-away position, the hydraulic cylinder 1602 controlling the lift position is extended and the hydraulic cylinder 1601 controlling the rotation position is extended. In FIG. 16D, the nightcap extractor 1600 is has placed the nightcap 1605 in a dock 1606. The horizontal support arm 1604 is in the nightcap-down position and its controlling hydraulic cylinder 1602 is retracted, and the vertical support arm 1603 is in the rotate-away position and its controlling hydraulic cylinder 1601 is extended. Thus, selective application of hydraulic pressures to the controlling hydraulic cylinders 1601, 1602 can be used to selectively position the vertical support arm 1603 and the horizontal support arm 1604 and thereby position the nightcap 1605 as desired.

Securing the nightcap 1605 to the flange assembly 102 via the clamp 103 is substantially the same as securing a crossover to the flange assembly 102, as described above. This can be further understood with reference to FIGS. 17A-18B, 20A-21C, and 22A-22F.

Figure 20A:
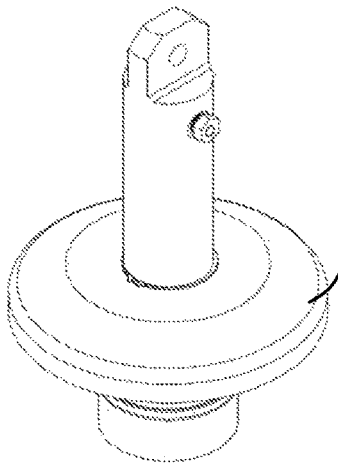
FIGS. 20A-20C are perspective, side, and side-sectional views, respectively, of an exemplary nightcap configured for use as part of a wellhead connection according to an aspect of the invention.
Figure 20B:
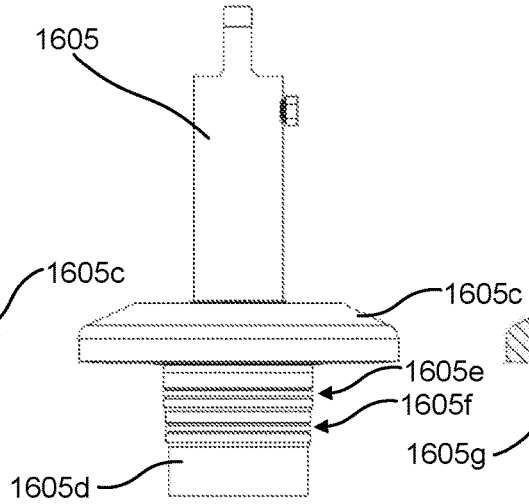
Figure 20C:
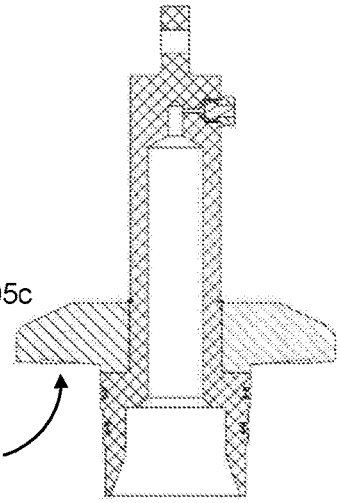
Figure 21A:
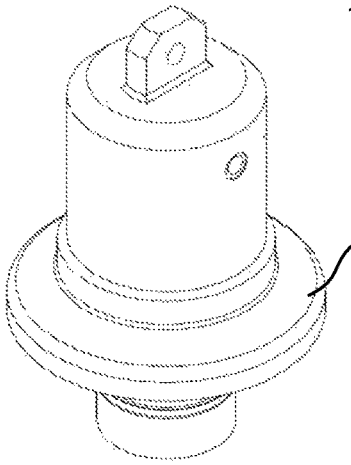
FIGS. 21A-21C are perspective, side, and side-sectional views, respectively, of an exemplary nightcap configured for use as part of a wellhead connection according to an aspect of the invention.
Figure 21B:
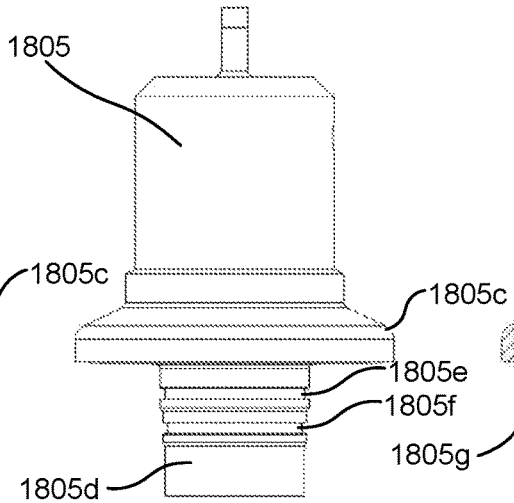
Figure 21C:
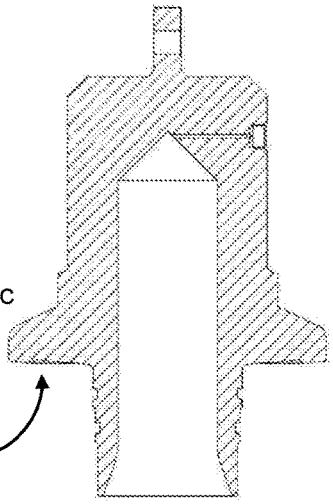
Figure 22A:
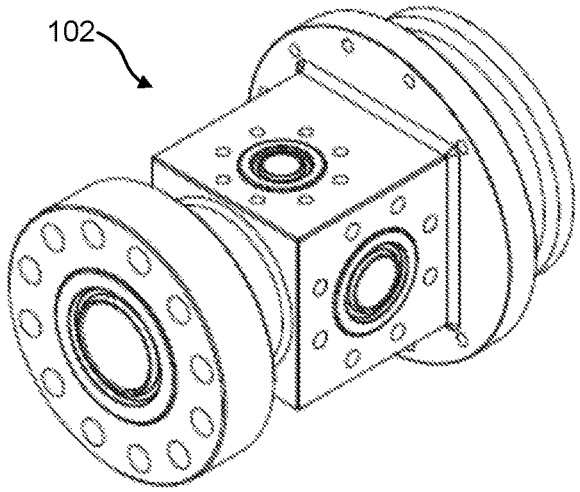
FIGS. 22A-22G are various views of an exemplary flange assembly of a wellhead connection according to an aspect of the invention.
Figure 22B:
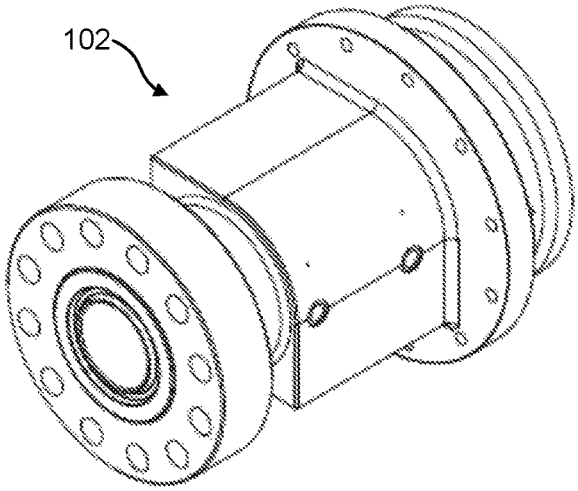
Figure 22C:
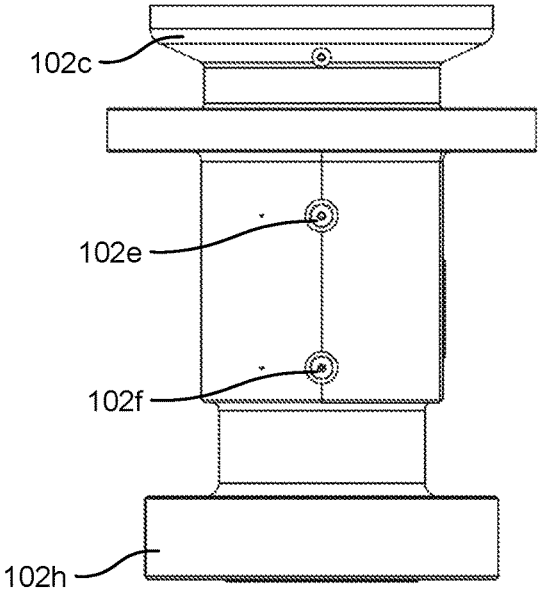
Figure 22D:
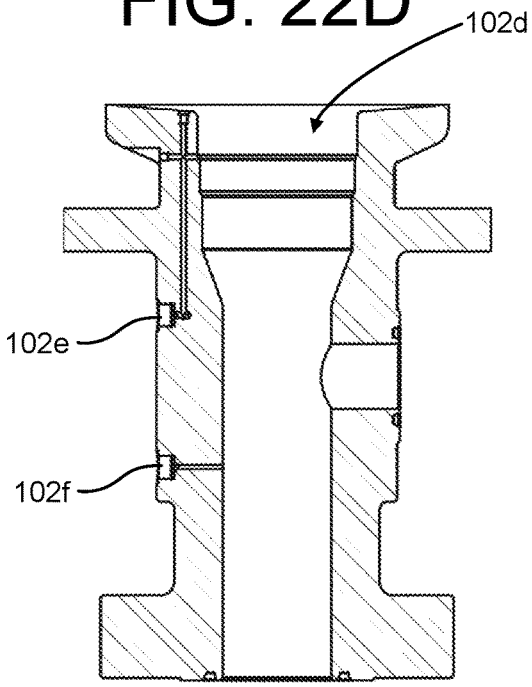
Figure 22E:
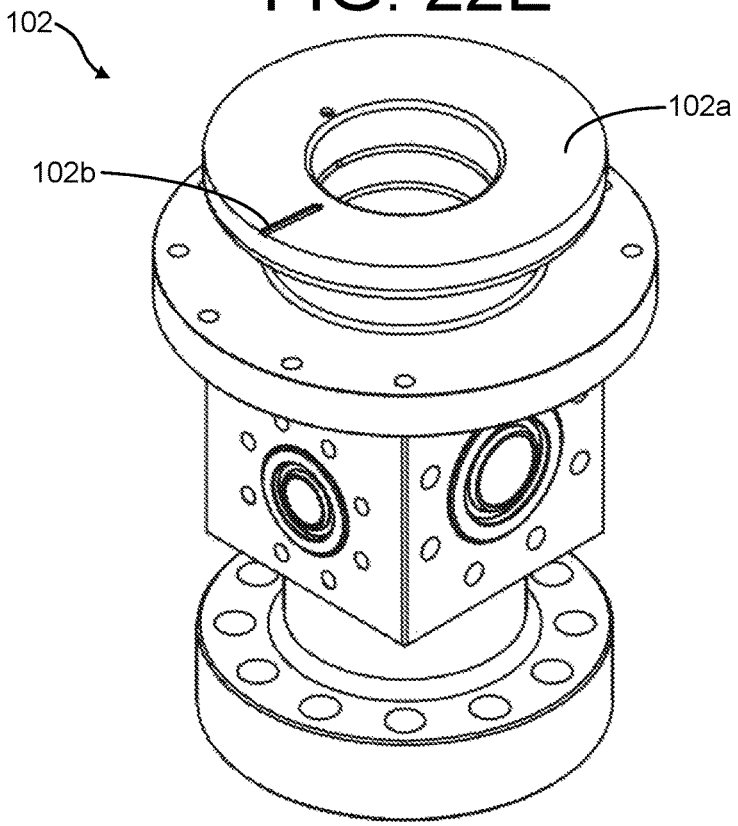
Figure 22F:
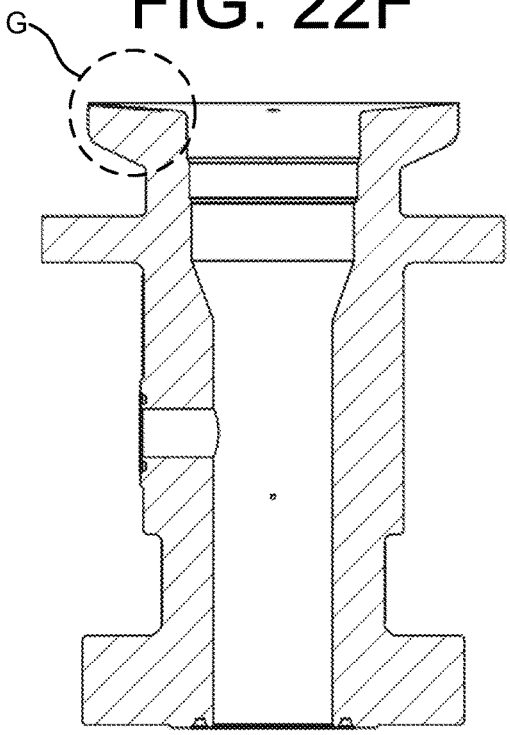
Figure 22G:
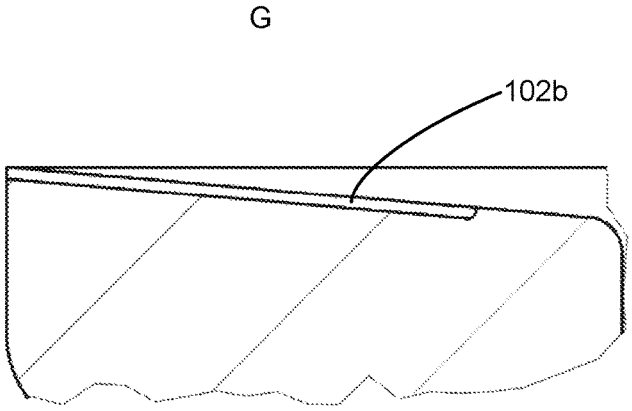

FIGS. 20A to 20C depict details of the exemplary nightcap 1605. The exemplary nightcap 1605 depicted in FIGS. 20A-20C includes a lower connection 1605*c*/1605*d* for connecting to a flange assembly 102. The lower connection 1605*c*/1605*d* includes a pin 1605*d* configured to fit in the receptacle 102*d* of the flange assembly 102 and a hub 1605*c* configured to engage the clamp 103. The pin 1605*d* includes mechanisms (e.g., as shown, with O-rings in grooves 1605*e*, 1605*f*) to create a seal between the pin 1605*d* and the flange assembly 102 for operation at a predetermined conditions primarily based on wellhead pressure (e.g., 10 kpsi over atmospheric pressure). (The seal mechanisms may also vary depending on fluids in the wellbore or temperature at the wellhead. For example, a different material or cross-sectional shape of the O-ring may be required for sour gas or higher temperatures.) The exemplary nightcap 1805 depicted in FIGS. 21A-21C is substantially similar to the nightcap 1605 depicted in FIGS. 20A-20C: it 1805 includes a lower connection 1805*c*/1805*d* for connecting to a flange assembly 102. The lower connection 1805*c*/1805*d* includes a pin 1805*d* configured to fit in the receptacle 102*d* of the flange assembly 102 and a hub 1805*c* configured to engage the clamp 103. The pin 1805*d* includes mechanisms (e.g., O-rings in grooves 1605*e*, 1605*f*) to create a seal between the pin 1605*d* and the flange assembly 102.

The nightcap may be provided with a debris groove at the hub face 1605*g*, 1805*g* as described above with respect to the crossover. Similarly, the nightcap hub face 1605*g*, 1805*g* may include a leak-detection groove as described above.

Figure 17A:
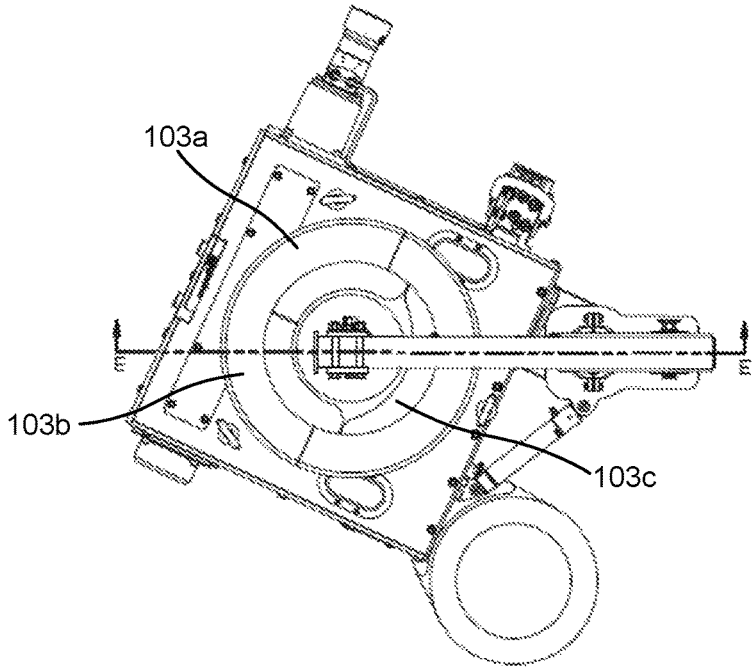
FIGS. 17A-17B are top and sectional views of an exemplary wellhead connection with an exemplary nightcap extractor and a clamp assembly in an "clamped" or "closed" position according to an aspect of the invention.
Figure 17B:
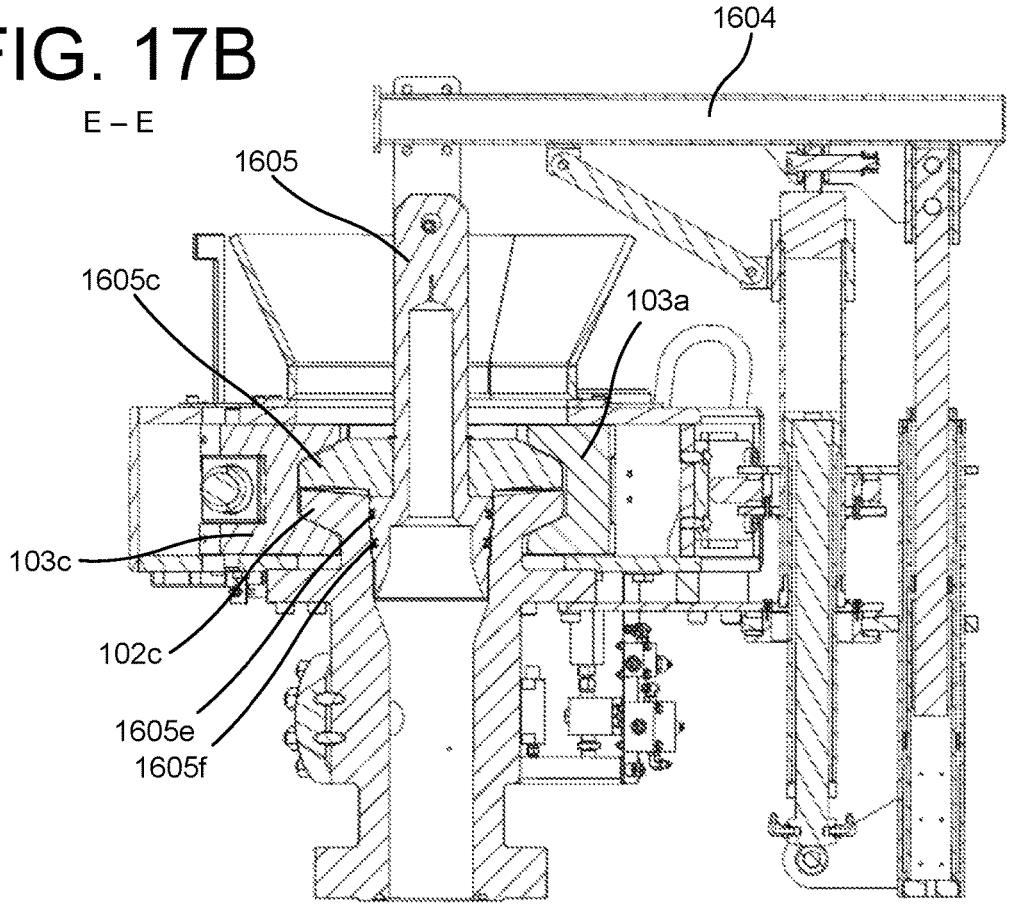

In FIGS. 17A-17B, the nightcap 1605 is depicted as connected to the flange assembly 102 via the clamp 103 in a closed position. The O-rings inserted in the grooves 1605*e*, 1605*f* of the nightcap 1605 are compressed into the annular gap between the surface of the flange assembly's receptacle 102*d* and surface of the nightcap's pin 1605*d*. As is well known in the art of seals, an O-ring under pressure (i.e., a pressure differential across the O-ring) is mechanically squeezed out of shape to close the annular gap between the surface of the flange assembly's receptacle 102*d* and surface of the nightcap's pin 1605*d*. A pressure differential beyond the O-rings' pressure limit will cause the O-rings to fail and fluid to flow in the annular gap (and to escape from the well to the surface). Under pressure (i.e., a wellhead pressure above ambient), the clamp 103 holds the nightcap 1605 in place relative to the flange assembly such that the O-rings continue to engage the surface of flange assembly's receptacle 102*d* and to fill the gap between the surface of the flange assembly's receptacle 102*d* and surface of the nightcap's pin 1605*d*. That is, the wellhead pressure that tends to force the nightcap 1605 away from the flange assembly 102 (up in the figure) is resisted by the clamp 103 simultaneously engaging the nightcap's hub 1605*c* and the flange assembly's hub 102*c*. Some movement of the nightcap 1605 relative to the flange assembly 102 is acceptable, so long as the O-rings remain within the flange assembly's receptacle 102*d* to fill the annular gap. (This description of the seal is also applicable to the crossover 105.)

Figure 18A:
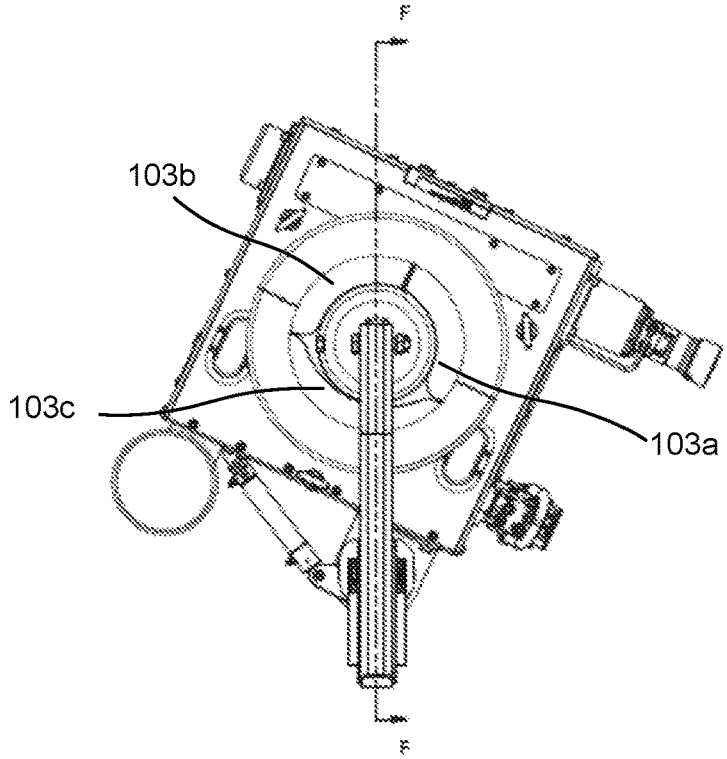
FIGS. 18A-18B are top and sectional views of an exemplary wellhead connection with an exemplary nightcap extractor and a clamp assembly in an "clamped" or "closed" position according to an aspect of the invention.
Figure 18B:
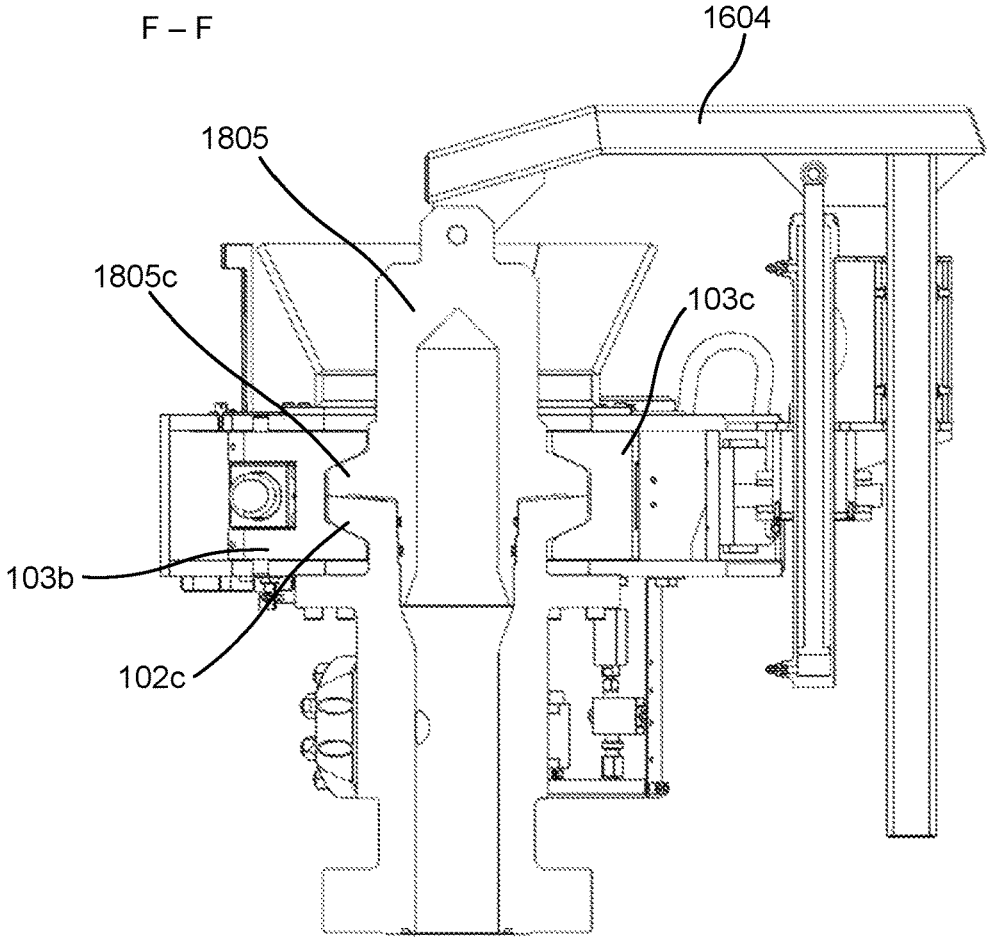

The nightcap connection depicted in FIGS. 18A-18B is substantially the same as depicted in FIGS. 17A-17B. The difference being the top part of the nightcap.

As depicted most clearly in FIG. 19, the nightcap extractor 1600 includes a nightcap connector 1608 to secure the nightcap 1605 to the horizontal support arm 1604. The nightcap connector 1608 may be configured to allow the nightcap 1605 to slightly pivot relative to the horizontal support arm 1604 or to translationally move relative to the longitudinal axis of the horizontal support arm 1604. This enables the nightcap to better engage or disengage the flange assembly 102.

Further detail of the exemplary flange assembly 102 is depicted in FIGS. 22A-22F. A pressure transducer (or other pressure sensor) may be connected to a pressure-transducer port 102*f* positioned below (toward the wellhead) the O-rings in a connected crossover or nightcap. This enables monitoring of wellbore pressure at the wellhead during operations. A quick-test system may be connected to a quick-test port 102*e*. This enables pressure testing of the seal between the crossover or nightcap and the flange assembly by selective application of hydraulic pressure at the seal. For example, the seal may include an upper O-ring seal and a lower O-ring seal. A quick test of such a seal can be performed by applying a pressure between the upper and lower seals. The seals are good if pressure is maintained (indicative of no fluid flow in the annular gap) and are not if pressure bleeds off (indicative fluid flow in the annular gap). If the flange assembly 102 is equipped with a leak detection groove 102*b*, the operator may be able to determine which seal failed in that if the upper seal failed, fluid will appear at the leak-detection groove 102*b*. Monitoring of the pressure at the quick-test port 102*e* may also be used to monitor the status of the seal during operations.

The flange assembly may also include a pump-in port to enable connection to the wellbore to, for example, pump fluids into the wellbore or to flow fluids out of the wellbore. And it may include a ball-drop port to enable dropping of frac balls into the well.

The wellhead connection 100 (or 100*) is remotely operated through selective provision and monitoring of hydraulic pressure to the wellhead connection. Through the provision of pressure to the hydraulic motor 104*d*, the clamp 103 can be remotely opened and closed to selectively secure the crossover 105 to the flange assembly 102 or release the crossover 105 from the flange assembly. Through the provision of pressure to the hydraulic cylinders 1601, 1602 of the nightcap extractor, a nightcap 1605 can be selectively secured to or extracted from the flange assembly 102.

Figure 23:
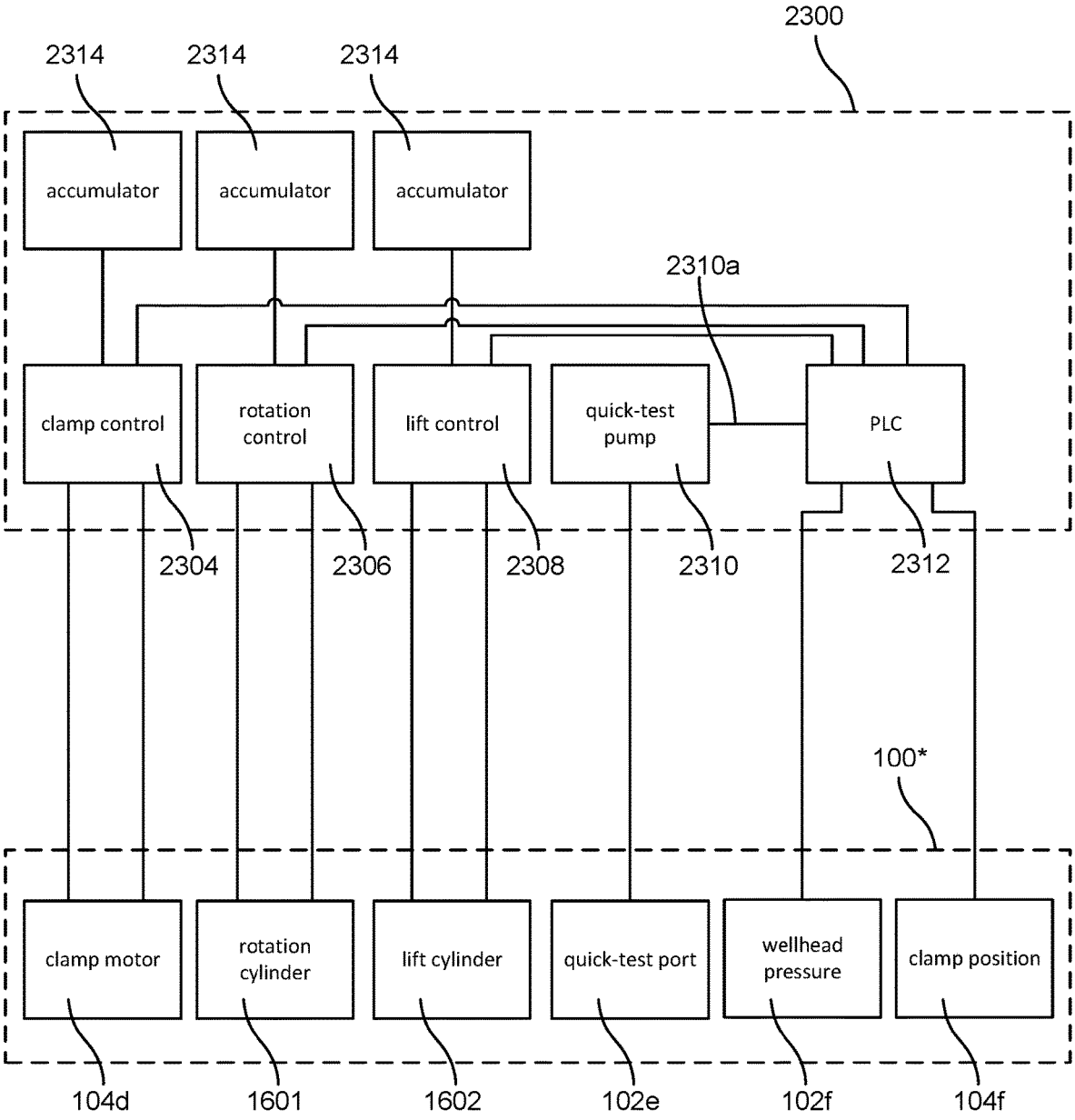
FIG. 23 is functional block diagram for an exemplary hydraulic and control circuit of a wellhead connection according to an aspect of the invention.
Figure 24:
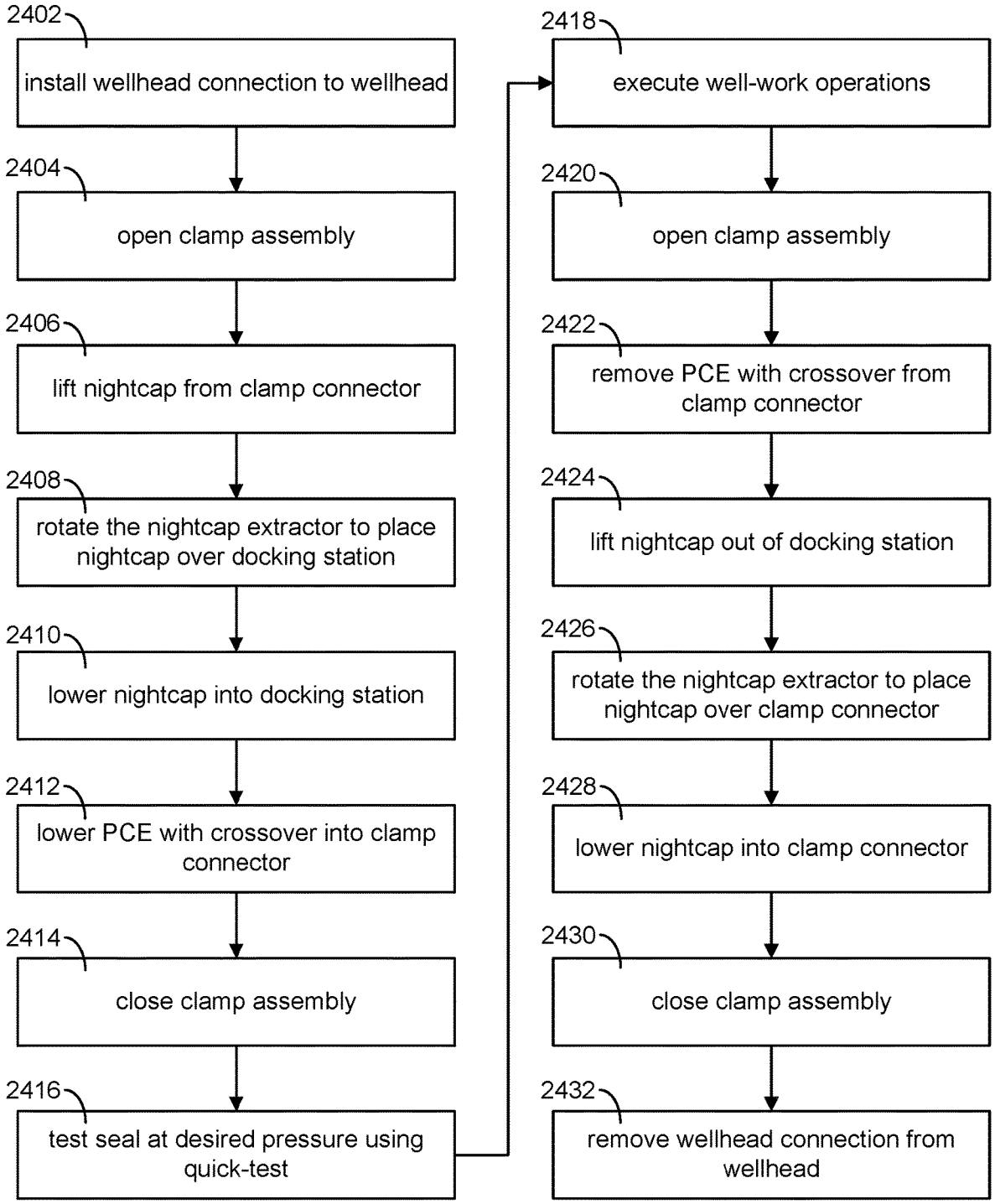
FIG. 24 is an exemplary operation flow for operating a wellhead connection according to an aspect of the invention.

The operation of the wellhead connection 100 or 100* can be understood with reference to FIG. 23 (an exemplary functional block diagram) and FIG. 24 (an exemplary operation flow chart). Operation of the wellhead connection 100 or 100* basically entails selectively providing hydraulic pressure to the clamp-control motor 104*d*, the nightcap-rotation cylinder 1601, and the nightcap-lift cylinder 1602. A control unit 2300 includes a reservoir of pressurized hydraulic fluid provided through one or more accumulators 2314 sourced, e.g., by a pump (not shown). The unit 2300 includes three controls (e.g., one or more manual valves or electronically-controlled solenoid valves) 2304, 2306, 2308, one for each of the clamp-control motor 104*d*, nightcap-rotation cylinder 1601, and nightcap-lift cylinder 1602, that may be operated to connect the reservoir to the motor or cylinder for the desired operation. There may be a combined reservoir for all or some of the controls or separate reservoirs for each control.

For example, a clamp control 2304 may connect the reservoir to the clamp motor 104*d* in one configuration to close the clamp 103 and in another configuration to open the clamp 103 (e.g., for a two-line motor, the pressure differential between lines may be reversed using a directional valve). Similarly, a nightcap-rotation control 2306 may connect the reservoir to the nightcap-rotation cylinder 1601 in one configuration to rotate the nightcap 1605 above the flange assembly 102 and in another configuration to rotate the nightcap 1605 above the dock 1606 (e.g., for a two-line, double-acting cylinder, the pressure differential between lines may be reversed using a directional valve). Similarly, a nightcap-lift control 2308 may connect the reservoir to the nightcap-lift cylinder 1602 in one configuration to raise the nightcap 1605 to disengage from the flange assembly 102 or dock 1606 and in another configuration to lower the nightcap 1605 to engage the flange assembly 102 or dock 1606 (e.g., for a two-line, double-acting cylinder, the pressure differential between lines may be reversed using a directional valve).

A quick-test pump 2310 (e.g., a hand pump or accumulator) may be used to provide hydraulic fluid at pressure to the flange assembly's quick-test port 102*e*. (And if the seals are of different diameter, the quick-test pump 2310 may also be used to help disengage a nightcap or crossover when the clamp is fully opened.)

An electronic controller/processor 2312 (e.g., a programmable logic controller or microcontroller) may mediate operation of the controls 2304, 2306, 2308. The controller 2312 receives wellhead pressure information from a transducer connected to the flange assembly's pressure-transducer port 102*f*, clamp-position information from the clamp-control's clamp-position sensor 104*f*, and quick-test pressure information 2310*a* from a quick-test-pump transducer. The controller 2312 may also receive operator input for operation of the clamp motor 104*d* or nightcap hydraulic cylinders 1601, 1602 and use the information to appropriately set the controls 2304, 2306, 2308. For example, if the operator provides an open-clamp instruction (through, e.g., a hard-wired switch or through a software interface), the controller 2312 will provide signals to set the clamp control 2304 in the appropriate state (e.g., open solenoid valve(s) to provide hydraulic fluid to drive the clamp-control motor in the appropriate direction). On a close-clamp instruction, the controller 2312 will provide signals to set the clamp control 2304 in the appropriate state (e.g., set solenoid valve(s) to provide hydraulic fluid to drive the clamp-control motor in the appropriate direction). Similarly, an instruction to raise or lower the nightcap will result in the controller 2312 providing signals to solenoid(s) to set the valve(s) of lift control 2308 in the appropriate state. And an instruction to rotate the nightcap will result in the controller 2312 providing signals to the solenoid valve(s) to set the valve(s) of rotation control 2306 in the appropriate state. Alternatively, the control may involve operator manipulation of manual valves in the controls 2304, 2306, 2308 independent of the controller 2312.

The controller 2312 may implement safety interlocks. For example, it may disable opening the clamp 103 if the wellhead pressure is above a threshold predetermined by, e.g., the manufacturer, by the operator, or the wellsite manager (e.g., if wellhead pressure>threshold, then the clamp control 2304 is disabled by blocking or not sending clamp-open signals to solenoid valve(s) of the clamp control 2304 or by sending only a fully-closed signal to these valve(s)). Alternatively, it may enable operation of the clamp control 2304 only if the wellhead pressure is less than the threshold by opening a solenoid valve. (The control 2304 may be a combination of a manual valve and an electronically-controlled solenoid valve. The solenoid valve may be placed between the accumulator 2314 and the manual valve such as to provide the interlock function by selectively closing/opening the hydraulic circuit between the accumulator 2314 and manual valve.) Similarly, the controller 2312 may disable operating the nightcap hydraulic cylinders

1601, 1602 if the clamp is not fully open (e.g., if clamp-position sensor information < > fully-opened value, then the rotational control 2306 and the lift control 2308 are each disabled by closing one or more valves to ensure the accumulator 2314 remains hydraulically disconnected from the rotation cylinder 1601 and the lift cylinder 1602).

The PLC may record wellhead pressure, clamp position, and quick-test pressure as a function of time for later examination of operations. The PLC may also transmit this information via wireless (e.g., Wi-Fi, cellular) or wired (e.g., Ethernet) communications.

An exemplary operation of a wellhead connection with nightcap extractor is depicted in the flow diagram of FIG. 24. After arriving on location, the wellhead connection is installed on a wellhead 2402 (often, a single location will have more than one wellhead and a wellhead connection is installed on each wellhead), a control unit is setup remote from the wellhead and hydraulically and electrically connected to the wellhead connection. Typically, the wellhead connection arrives on location with a nightcap connected to the flange assembly via the clamp. To begin well operations with PCE, the clamp is opened 2404, the nightcap is lifted from the clamp connection 2406, the nightcap is rotated in position over the dock 2408, and the nightcap is lowered into the dock 2410. Next, the PCE/crossover is positioned over the flange assembly and lowered into the clamp connector 2412 (e.g., using a crane) at which point the clamp is closed 2414 to secure the crossover (and thus the PCE) to the flange assembly. The operator then tests the seal between the flange assembly and crossover by applying the desired level of hydraulic pressure to the quick test port on the flange assembly 2416. If the seal holds, work on the well proceeds 2418. If the seal fails, the clamp is opened, the PCE/crossover is lifted from the clamp connector and away from the wellhead to assess the reasons for the failure. If the failure is remedied, the operator can enter reposition the PCE/crossover into the clamp 2412 and proceed to test 2416 and, if the seal holds, perform operations 2418.

Once work on the well is completed, the clamp is opened 2420 and the PCE/crossover lifted from the connector 2422 and move away from the wellhead. The nightcap is then reinstalled by engaging the extractor to lift the nightcap out of the dock 2424, rotating the extractor to place the nightcap over the flange assembly/clamp connector 2426, lowering the nightcap into the clamp connector 2428, and closing the clamp 2430. At this point, the operator may check the seal between nightcap and flange assembly using the quick-test port (as described above) if the wellhead connection and nightcap are to remain in place to protect the well from the environment, and vice versa. When all operations are complete, the wellhead connection is removed from the wellhead 2432 and is ready for use on the next location.

Figure 25:
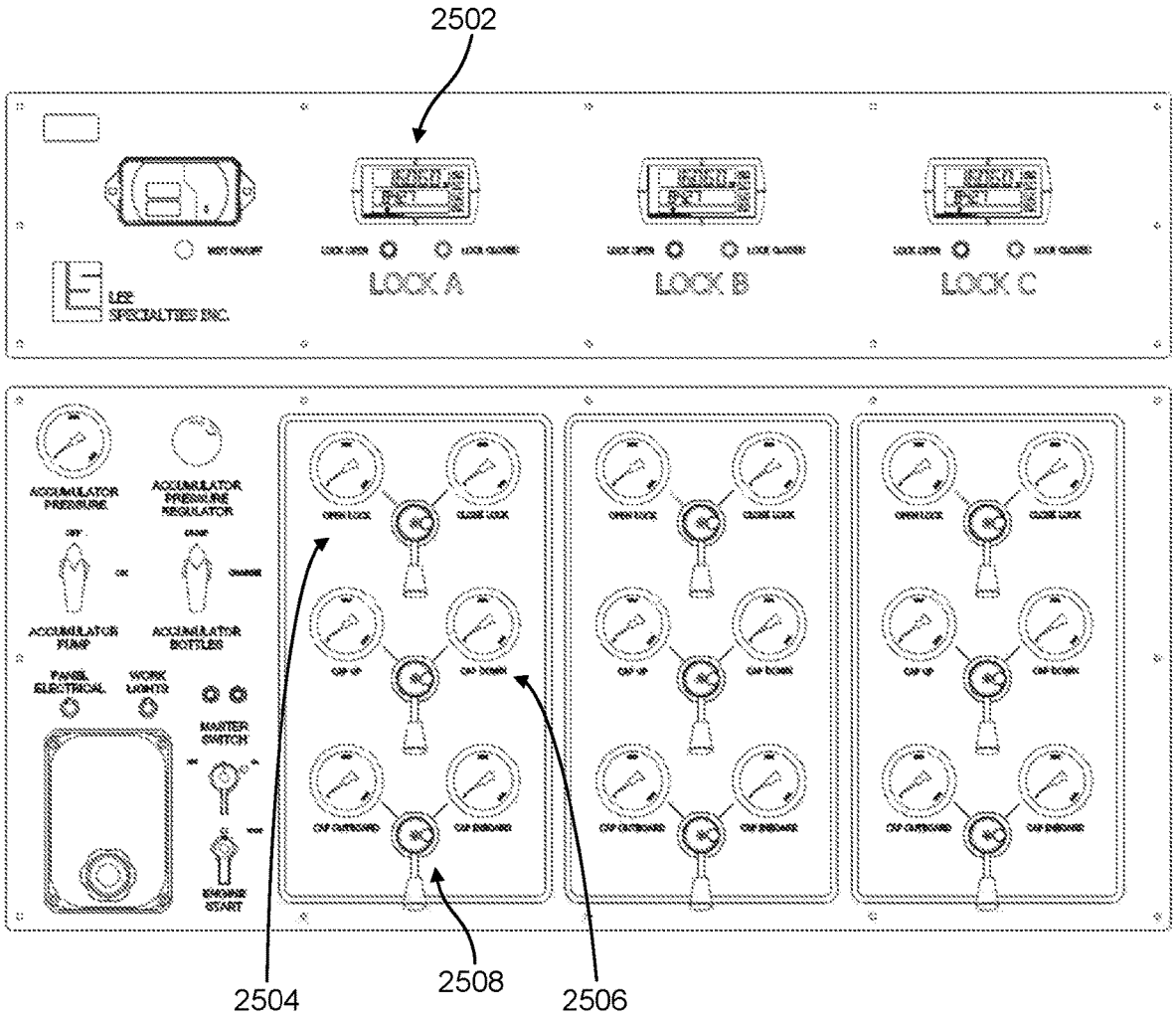
FIG. 25 depicts an exemplary control panel for a remotely controlled wellhead connection according to an aspect of the invention.

FIG. 25 illustrates an exemplary panel of a control unit 900 capable of operating three separate wellhead connections ("LOCK A," "LOCK B," "LOCK C"). The panel includes a display 2502 for displaying the quick-test pressure 2301*a*, the wellhead pressure (from the flange-assembly transducer in port 102*f*), and the clamp position (from clamp-position sensor 104*f*, "LOCK OPEN"/"LOCK CLOSED" in the figure). The panel also includes a clamp-control interface 2504 through which an operator can open and close the clamp 103, a nightcap-lift-control interface 2506 through which an operator can lift and lower the nightcap 1605, and a nightcap-rotation-control interface 2508 through which an operator can rotate the nightcap 1605 to be above the flange assembly 102 or above the dock 1606.

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. A wellhead connection comprising:

(a) a flange assembly comprising:
- (i) a first flange-assembly end configured to connect to a wellhead;
- (ii) a second flange-assembly end comprising a clamp hub and a clamp-hub face;
- (iii) an interior surface defining a receptacle;

(b) a clamp assembly comprising a plurality of clamp segments, wherein the clamp segments are each configured to engage the flange-assembly clamp hub;

(c) a clamp-control assembly comprising:
- (i) a screw-threaded shaft;
- (ii) a motor configured to rotate the screw-threaded shaft;
- (iii) a first threaded positioning unit connected to one of the clamp segments;
- (iv) a second threaded positioning unit connected to a one of the clamp segments different from the one of the clamp segments connected to the first threaded positioning unit;
- (v) wherein the screw-threaded shaft engages the threaded positioning units such that rotation of the screw-threaded shaft in one direction causes the positioning units to move toward each other and in the other direction causes the positioning units to move away from each other; and (d) a nightcap-extractor assembly comprising:
- (i) a first elongated arm connected to the flange assembly;
- (ii) a second elongated arm connected to the first arm;
- (iii) a first hydraulic cylinder configured to selectively provide force to the first arm to move the first arm relative to the flange assembly;
- (iv) a second hydraulic cylinder to configured selectively provide force to the first arm relative to the flange assembly to rotate the first arm about the first arm's longitudinal axis.

2. The wellhead connection of claim 1 further comprising:

(a) a crossover comprising:
- (i) a first crossover end configured to connect to pressure control equipment;
- (ii) a second crossover end comprising a clamp hub configured to engage the clamp segments and a clamp-hub face configured to engage the flange-assembly clamp-hub face; and
- (iii) the second crossover end further comprising a pin configured to fit in the flange-assembly receptacle such that there is an annular gap between an outer surface of the crossover pin and the flange-assembly interior surface that defines the receptacle; and (b) a first seal positioned to circumferentially fill the annular gap between the outer surface of the crossover pin and the flange-assembly interior surface that defines the receptacle.

3. The wellhead connection of claim 2 further comprising:
(a) a second seal positioned to circumferentially fill the annular gap between the outer surface of the crossover pin and the flange-assembly interior surface that defines the receptacle; and
(b) a quick-test port disposed in the flange assembly and configured to provide a hydraulic-fluid passage between the first seal and the second seal.

4. The wellhead connection of claim 1 further comprising:
(a) a nightcap comprising:
(i) a clamp hub configured to engage the clamp segments and a clamp-hub face configured to engage the flange-assembly clamp-hub face; and
(ii) a pin configured to fit in the flange-assembly receptacle such that there is an annular gap between the outer surface of the nightcap pin and the flange-assembly interior surface that defines the receptacle; and
(b) a first seal configured to circumferentially fill the annular gap between the outer surface of the nightcap pin and the flange-assembly interior surface that defines the receptacle.

5. The wellhead connection of claim 4 further comprising:
(a) a second seal positioned to circumferentially fill the annular gap between the outer surface of the nightcap pin and the flange-assembly interior surface that defines the receptacle; and
(b) a quick-test port disposed in the flange assembly and configured to provide a hydraulic-fluid passage terminating at a point between the first seal and the second seal.

6. The wellhead connection of claim 1 further comprising:
(a) a pressure transducer disposed in the flange assembly and configured to provide pressure information; and
(b) a controller configured to selectively disable the motor based on the pressure-transducer pressure information.

7. The wellhead connection of claim 1 further comprising:
(a) a clamp-position sensor; and
(b) a controller configured to selectively disable any change of state of the first hydraulic cylinder or the second hydraulic cylinder.

8. A wellhead connection comprising:
(a) a flange assembly comprising:
(i) a first flange-assembly end configured to connect to a wellhead;
(ii) a second flange-assembly end comprising a flange-assembly clamp hub;
(b) a nightcap comprising a nightcap clamp hub;
(c) a clamp configured to simultaneously engage the flange-assembly clamp hub and the nightcap clamp hub;
(d) a seal configured to be disposed between the flange assembly and nightcap;
(e) a clamp-control means for selectively engaging and disengaging the clamp with the flange-assembly clamp hub and the nightcap clamp hub;
(f) a nightcap-positioning means for selectively engaging and disengaging the nightcap with the flange assembly;
(g) a wellhead-pressure sensor to measure the wellhead pressure; and
(h) an interlock means for disabling the clamp-control means based on a wellhead pressure provided by the wellhead-pressure sensor.

9. A wellhead connection comprising:
(a) a flange assembly comprising:
(i) a first flange-assembly end configured to connect to a wellhead;
(ii) a second flange-assembly end comprising a flange-assembly clamp hub;
(b) a nightcap comprising a nightcap clamp hub;
(c) a clamp configured to simultaneously engage the flange-assembly clamp hub and the nightcap clamp hub;
(d) a seal configured to be disposed between the flange assembly and nightcap;
(e) a clamp-control means for selectively engaging and disengaging the clamp with the flange-assembly clamp hub and the nightcap clamp hub;
(f) a nightcap-positioning means for selectively engaging and disengaging the nightcap with the flange assembly;
(g) a clamp-position sensor to measure the clamp position; and
(h) an interlock means for disabling the nightcap-positioning means based on a clamp position provided by the clamp-position moans sensor.

10. A method of remotely operating a wellhead connection having a flange assembly to connect to a wellhead, a crossover to connect to pressure-control equipment, and a nightcap, the method comprising:
(a) selectively positioning the nightcap, wherein selectively positioning the nightcap includes selective application of hydraulic pressure to at least one of a plurality of hydraulic cylinders;
(b) selectively clamping and unclamping the nightcap to the flange assembly, wherein selectively clamping and unclamping the nightcap includes selective application of hydraulic pressure to at least one hydraulic motor;
(c) selectively clamping and unclamping the crossover to the flange assembly, wherein selectively clamping and unclamping the crossover includes selective application of hydraulic pressure to at least one hydraulic motor;
(d) receiving clamp-position information; and
(e) selectively disabling an change of state of the plurality of hydraulic cylinders based on the clamp-position information.

* * * * *